US010550512B2

(12) United States Patent
Aso et al.

(10) Patent No.: US 10,550,512 B2
(45) Date of Patent: Feb. 4, 2020

(54) OIL AGENT FOR CARBON-FIBER-PRECURSOR ACRYLIC FIBER, OIL AGENT COMPOSITION FOR CARBON-FIBER-PRECURSOR ACRYLIC FIBER, OIL-TREATMENT-LIQUID FOR CARBON-FIBER-PRECURSOR ACRYLIC FIBER, AND CARBON-FIBER-PRECURSOR ACRYLIC FIBER BUNDLE

(71) Applicant: Mitsubishi Chemical Corporation, Tokyo (JP)

(72) Inventors: Hiromi Aso, Tokyo (JP); Mitsuhiro Hamada, Tokyo (JP); Satoshi Nagatsuka, Tokyo (JP); Tetsuo Takano, Wakayama (JP); Motoi Konishi, Wakayama (JP); Masaaki Tsuchihashi, Wakayama (JP)

(73) Assignee: Mitsubishi Chemical Corporation, Tokyo (JP)

( * ) Notice: Subject to any disclaimer, the term of this patent is extended or adjusted under 35 U.S.C. 154(b) by 473 days.

(21) Appl. No.: 15/509,754

(22) PCT Filed: Sep. 11, 2015

(86) PCT No.: PCT/JP2015/075939
§ 371 (c)(1),
(2) Date: Mar. 8, 2017

(87) PCT Pub. No.: WO2016/039478
PCT Pub. Date: Mar. 17, 2016

(65) Prior Publication Data

US 2017/0284016 A1 Oct. 5, 2017

(30) Foreign Application Priority Data

Sep. 11, 2014 (JP) ..... 2014-184903
Sep. 11, 2014 (JP) ..... 2014-184904

(51) Int. Cl.
*D06M 15/643* (2006.01)
*D06M 13/224* (2006.01)
*D01F 9/26* (2006.01)
*D06M 101/26* (2006.01)

(52) U.S. Cl.
CPC ..... *D06M 15/6436* (2013.01); *D01F 9/26* (2013.01); *D06M 13/224* (2013.01); *D06M 2101/26* (2013.01)

(58) Field of Classification Search
CPC ..... D06M 15/6436; D06M 13/224; D06M 2101/26; D06M 2101/28; D06M 2200/40; D06M 13/2246; D01F 9/26; D01F 9/22
See application file for complete search history.

(56) References Cited

U.S. PATENT DOCUMENTS

| | | | | |
|---|---|---|---|---|
| 5,783,305 | A | 7/1998 | Masaki et al. | |
| 2009/0263576 | A1 | 10/2009 | Okabe et al. | |
| 2013/0338281 | A1 | 12/2013 | Aso | |
| 2014/0134094 | A1* | 5/2014 | Aso | D06M 13/224 423/447.4 |

FOREIGN PATENT DOCUMENTS

| | | | |
|---|---|---|---|
| JP | 2000-199183 | A | 7/2000 |
| JP | 2002-266239 | A | 9/2002 |
| JP | 2003-55881 | A | 2/2003 |
| JP | 2004-149937 | A | 5/2004 |
| JP | 2004-169198 | A | 6/2004 |
| JP | 2005-264361 | A | 9/2005 |
| JP | 2005-264384 | A | 9/2005 |
| JP | 2010-24582 | A | 2/2010 |
| JP | 2010-53467 | A | 3/2010 |
| JP | 2011-42916 | A | 3/2011 |
| JP | 2013-249572 | A | 12/2013 |
| WO | 97/09474 | A1 | 3/1997 |
| WO | 2007/066517 | A1 | 6/2007 |
| WO | 2012/117514 | A1 | 9/2012 |
| WO | 2012/169551 | A1 | 12/2012 |

* cited by examiner

OTHER PUBLICATIONS

International Search Report dated Dec. 15, 2015 in PCT/JP2015/075939 filed Sep. 11, 2015.

*Primary Examiner* — Daniel C. McCracken
(74) *Attorney, Agent, or Firm* — Oblon, McClelland, Maier & Neustadt, L.L.P.

(57) ABSTRACT

An oil for a carbon fiber precursor acrylic fiber including: a hydroxybenzoate ester (A) indicated by formula (1a); an amino-modified silicone (H) indicated by formula (3e); and an organic compound (X) which is compatible with the hydroxybenzoate ester (A), in which a residual mass rate R1 at 300° C. in thermal mass analysis in an air atmosphere is 70-100 mass % inclusive, and which is a liquid at 100° C., and a carbon fiber precursor acrylic fiber bundle to which the oil for a carbon fiber precursor acrylic fiber is adhered.

[chem 1]

(1a)

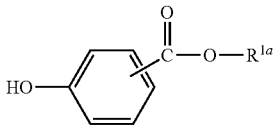

(3e)

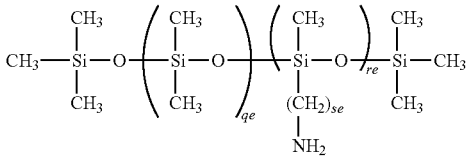

15 Claims, No Drawings

OIL AGENT FOR CARBON-FIBER-PRECURSOR ACRYLIC FIBER, OIL AGENT COMPOSITION FOR CARBON-FIBER-PRECURSOR ACRYLIC FIBER, OIL-TREATMENT-LIQUID FOR CARBON-FIBER-PRECURSOR ACRYLIC FIBER, AND CARBON-FIBER-PRECURSOR ACRYLIC FIBER BUNDLE

TECHNICAL FIELD

The present invention relates to an oil agent for carbon-fiber-precursor acrylic fibers, an oil agent composition for carbon-fiber-precursor acrylic fibers, an oil-treatment-liquid for carbon-fiber-precursor acrylic fibers, and a carbon-fiber-precursor acrylic fiber bundle.

The present application is based upon and claims the benefit of priority to Japanese Application Nos. 2014-184903 and 2014-184904, both filed Sep. 11, 2014, the entire contents of which are incorporated herein by reference.

BACKGROUND ART

As a method for manufacturing carbon-fiber bundles, a conventionally known method is carried out by converting a carbon-fiber-precursor fiber bundle (hereinafter, may also be referred to as a "precursor-fiber bundle") made of acrylic fibers or the like into a stabilized fiber bundle by heating the bundle at 200 to 400° C. in an oxidizing atmosphere (stabilization process), and by carbonizing the bundle at 1000° C. or higher in an inert atmosphere (carbonization process). Carbon-fiber bundles obtained by such a method exhibit excellent mechanical properties and are widely used as reinforcing fibers especially for composite materials.

However, in manufacturing methods of carbon-fiber bundles during stabilization and subsequent carbonization processes (hereinafter, a stabilization process and a carbonization process may be combined and referred to as a "calcination process"), problems may occur such as fuzzy fibers or yarn breakage because single fibers are fused during a process for converting a precursor-fiber bundle to a stabilized fiber bundle. As a method for preventing single fibers from fusing, applying an oil agent composition on surfaces of precursor-fiber is known (oil treatment), and various oil agent compositions have been studied.

Silicone-based oil agents that contain a silicone as the main component have been used as oil agents in oil agent compositions so as to prevent fusion among single fibers. As the silicones, modified silicones with reactive groups, such as aminos, epoxies and polyethers, have been generally used because of their affinity with and retention on precursor-fiber.

However, when silicone-based oil agents are heated, crosslinking reactions progress to cause high viscosity, and such viscous agents tend to be deposited on surfaces of fiber transport rollers and guides used for manufacturing process and stabilization process of precursor-fiber bundles. Accordingly, the precursor-fiber bundles or stabilized fiber bundles may be wound around or snagged on fiber transport rollers or guides and cause yarn breakage, thus lowering operational efficiency accordingly.

Moreover, during the calcination process, a precursor-fiber bundle with applied silicone-based oil agent tends to produce inorganic silicon compounds such as silicon oxide, silicon carbide and silicon nitride, and to lower industrial productivity.

In recent years, while even larger-scale production facilities and higher productivity have been required in response to an increase in demand for carbon fibers, one of the issues to be solved is a decrease in industrial productivity caused by formation of inorganic silicon compounds during the calcination process.

Accordingly, oil agent compositions with a reduced silicone content have been proposed in an attempt to reduce the amount of silicone in oil-treated precursor-fiber bundles; for instance, in an oil agent composition, the silicone content is lowered by adding 40 to 100 mass % of an emulsifier that contains a polycyclic aromatic compound at 50 to 100 mass % (see Patent Literature 1.)

Another oil composition has been proposed, in which a silicone is blended with a heat-resistant resin having a residual rate of 80 mass % or higher after being heated in air atmosphere at 250° C. for 2 hours (see Patent Literature 2).

In addition, an oil composition has been proposed, in which the silicone content is reduced by adding 80 to 95 mass % of esterified ethylene oxide and/or propylene oxide adducts of bisphenol A esterified with higher fatty acid at both ends (see Patent Literature 3).

Other examples are an oil agent composition made by combining a bisphenol A based aromatic compound and an amino-modified silicone (see Patent Literatures 4 and 5), and an oil agent composition mainly composed of a fatty acid ester of an alkylene oxide adduct of bisphenol A (see Patent Literature 6).

Meanwhile, it has been also proposed to form an oil composition with a lower silicone content by using a compatibilizer so that affinity is enhanced when silicone-based and non-silicone-based compounds are mixed (see Patent Literature 7). Another oil composition has also been proposed, which contains as essential components an ester compound having at least three ester groups in the molecule and a silicone-based compound (see Patent Literature 8). In such an oil composition, the silicone content is reduced by using an ester compound while preventing fusion among single fibers and achieving stable operational efficiency in the production of carbon fibers.

Moreover, by combining an ester compound containing at least three ester groups in the molecule and a water-soluble amide, the silicone content is lowered while fusion of fibers is prevented and stable operational efficiency is achieved (see Patent Literature 9).

Further proposed is an oil agent composition which contains at least 10 mass % of a compound having a reactive functional group but does not contain a silicone compound, or even if the oil agent composition contains a silicone compound, its content is 2 mass % or lower in terms of silicon mass (see Patent Literature 10).

Yet further proposed is an oil agent composition which contains 0.2 to 20 wt. % of an acrylic polymer having an aminoalkylene group in the side chain, 60 to 90 wt. % of a specific ester compound and 10 to 40 wt. % of a surfactant (see Patent Literature 11).

Yet further proposed is to use multiple oil agents when forming an oil agent for carbon-fiber-precursor acrylic fibers (see Patent Literature 12).

Moreover, an oil agent and oil agent composition have been proposed which contains at least one compound selected from a group consisting of specific ester compounds such as hydroxybenzoate and cyclohexanedicarboxylate (see Patent Literatures 13 and 14).

PRIOR ART PUBLICATION

Patent Literature

Patent Literature 1: JP2005-264384A
Patent Literature 2: JP2000-199183A
Patent Literature 3: JP2002-266239A
Patent Literature 4: JP2003-55881A
Patent Literature 5: JP2004-149937A
Patent Literature 6: WO1997/009474
Patent Literature 7: JP2004-169198A
Patent Literature 8: WO2007/066517
Patent Literature 9: JP2010-24582A
Patent Literature 10: JP2005-264361A
Patent Literature 11: JP2010-53467A
Patent Literature 12: JP2013-249572A
Patent Literature 13: WO2012/169551
Patent Literature 14: WO2012/117514

SUMMARY OF THE INVENTION

Problems to be Solved by the Invention

However, to achieve high emulsion stability, the oil agent composition described in Patent Literature 1 needs to use an emulsifier as much as 40 mass % or higher. In addition, when the oil agent composition is applied, the bundling properties of precursor-fiber bundles tend to decline. Thus, the composition is not suitable for achieving high productivity. Besides, there is such an issue that using the composition does not contribute well to producing carbon-fiber bundles having excellent mechanical properties.

Also, since oil agent compositions described in Patent Literatures 2, 3 and 4 use bisphenol A based aromatic esters as a heat-resistant resin, they exhibit significantly high heat resistance. However, fusion among single fibers is not sufficiently prevented, and it is hard to consistently produce carbon-fiber bundles having excellent mechanical properties. Especially, since the oil composition described in Patent Literature 2 forms a film on the surface of a fiber at 250° C. to 300° C., the film blocks diffusion of oxygen into the fiber during the stabilization process. Accordingly, uniform stabilization in the fiber is not achieved, thereby making it hard to consistently obtain carbon-fiber bundles with excellent mechanical properties. Moreover, due to its high heat resistance, the oil agent composition described in Patent Literature 2 may face production failure caused when the oil agent composition or its decomposed substances are deposited in the oven or on transport rollers during the stabilization process.

Also, oil agent compositions described in Patent Literatures 5 and 6 are not capable of providing stable production of carbon-fiber bundles that have excellent mechanical properties.

In addition, the oil compositions described in Patent Literatures 5 and 7 contain a compatibilizer and have a certain compatibilizing effect, but the compatibilizer needs to be contained as much as 10 mass % or greater because its affinity with silicone-based compounds is low. In addition, the compatibilizer may cause process failure due to, for example, tar generated by decomposition of the compabilizer in the calcination process.

Moreover, although the oil agent composition described in Patent Literature 8 is capable of providing stable operational efficiency, heat resistance is low when the composition contains only ester compounds with three or more ester groups in a molecule, thus making it hard to maintain the bundling properties during the stabilization process. Accordingly, the oil agent composition needs to contain a silicone compound, which in turn generates inorganic silicon compounds that cause trouble during the calcination process. In addition, when produced by using the oil agent composition described in Patent Literature 8, the mechanical properties of carbon-fiber bundles tend to be lower than those produced by using a silicone oil agent mainly composed of silicones.

Also, when substantially no silicone is present in the system, the oil agent composition containing a water-soluble amide compound described in Patent Literature 9 is not capable of maintaining stable operational efficiency and product quality.

The oil agent composition described in Patent Literature 10 is capable of enhancing the adhesiveness of an oil agent by increasing the composition viscosity at 100° C. to 145° C. However, due to its high viscosity, oil-treated precursor-fiber bundles tend to adhere to fiber transport rollers during a spinning process, thus causing problems such as causing a fiber bundles to be wound on the rollers.

Furthermore, although the oil agent composition described in Patent Literature 11 prevents fusion of the substrates of single fibers during the stabilization process, the components of the oil agent may act like an adhesive and are likely to adhere (agglutinate) multiple single fibers. Also, since such adhesion blocks the diffusion of oxygen into fiber bundles during the stabilization process, the stabilization treatment does not show a homogeneous result, thus causing problems such as fuzzy fibers or yarn breakage in the subsequent carbonization process.

When the oil agent described in Patent Literature 12 is used for a greater number of fibers, fiber processability decreases, and the fiber tensile strength tends to be low. In addition, further enhanced quality of the agent is desired for a certain type of carbon-fiber bundle.

Moreover, although the oil agent compositions described in Patent Literatures 13 and 14 are capable of preventing fusion or agglutination among single fibers during the calcination process, the ester components that tend to volatile by high temperature treatment may be vaporized (scattered) and cohere/adhere to wall surfaces or the like to cause contamination during the calcination process. In addition, the cohered substances of ester components may fall from the wall surfaces and stick to precursor-fiber bundles during the calcination process, thus lowering industrial productivity and product quality. Accordingly, improvement of ester components is desired.

As described above, compared with silicone-based oil agents, the aforementioned oil agents with a lower silicone content or oil agents containing ester components only may reduce the operational efficiency, the prevention effects on fusion among single fibers and the bundling properties of oil-treated precursor-fiber bundles, while also decreasing the mechanical properties of resultant carbon-fiber bundles. Moreover, ester components that tend to volatile by high temperature treatment may scatter and cohere on wall surfaces or the like to cause contamination during the calcination process. Then, the cohered substances of ester components may fall from the wall surfaces and stick to precursor-fiber bundles during the calcination process. As a result, industrial productivity and product quality decrease, making it harder to consistently produce high quality carbon-fiber bundles.

On the other hand, using a conventional silicone-based oil agent may cause other problems such as a reduction in operational efficiency due to high viscosity, or lowered industrial productivity due to the formation of inorganic silicon compounds as described above.

Namely, problems such as a reduction in operational efficiency and industrial productivity caused by using silicone-based oil agents are closely associated with problems such as a reduction in capability to prevent a fusion among single fibers, bundling properties of precursor-fiber bundles and mechanical properties of carbon-fiber bundles which are caused by using oil agents with a low silicone content or containing ester components only that tend to volatile, while also being closely associated with problems such as a reduction in operational efficiency and industrial productivity caused when ester components are vaporized. Accordingly, problems such as above are unlikely to be solved using conventional technology.

The objective of the present invention is to provide an oil agent for carbon-fiber-precursor acrylic fiber which is easily emulsified even with a low emulsifier content, an oil agent composition for carbon-fiber-precursor acrylic fibers, and an oil-treatment-liquid for carbon-fiber-precursor acrylic fibers; such an oil agent, oil agent composition and oil-treatment-liquid are capable of effectively preventing fusion among single fibers during the production process of carbon-fiber bundles, suppressing a reduction in operational efficiency, and producing carbon-fiber-precursor acrylic fiber bundles with excellent bundling properties so that carbon-fiber bundles having excellent mechanical properties are obtained at high yield.

Another objective of the present invention is to produce carbon-fiber-precursor acrylic fiber bundles, which exhibit excellent bundling properties and high operational efficiency, by using an oil agent that is easily emulsified even with a low emulsifier content. Such carbon-fiber-precursor acrylic fiber bundles are capable of preventing fusion among single fibers during the production process of carbon-fiber bundles, thus producing carbon-fiber bundles with excellent mechanical properties at high yield.

Solutions to the Problems

After conducting intensive studies, the present inventors have found that using an oil agent containing a hydroxybenzoate with a specific structure, an amino-modified silicone, and a specific organic compound can solve the problems that are derived from silicone-based oil agents, or from oil agents having a reduced silicone content or those containing ester components only. Accordingly, the present invention has been completed.

Namely, the present invention is characterized by the following aspects.

(1) An oil agent for carbon-fiber-precursor acrylic fibers containing

- a hydroxybenzoate (A) represented by formula (1a) below;
- an amino-modified silicone (H) represented by formula (3e) below; and
- an organic compound (X), which has affinity with the hydroxybenzoate (A) and a residual mass rate (R1) of 70 to 100 mass % at 300° C. measured by thermogravimetry in air, and which is liquid at 100° C.

[chem 1]

(1a)

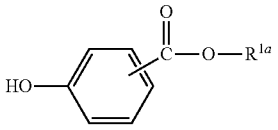

In formula (1a), $R^{1a}$ is a C8 to C20 hydrocarbon group.

[chem 2]

(3e)

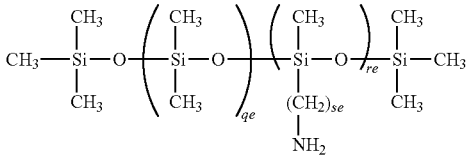

In formula (3e), "qe" and "re" are any number of 1 or greater, "se" is any number of 1 to 5, and the dimethylsiloxane units and methylaminoalkyl-siloxane units are in a random sequence.

(2) The oil agent for carbon-fiber-precursor acrylic fibers according to (1), in which the organic compound (X) is at least one type selected from a group of types consisting of

- a cyclohexanedicarboxylate (B) represented by formula (1b) below,
- a cyclohexanedicarboxylate (C) represented by formula (2b) below, and
- a fatty acid ester of polyoxyethylene bisphenol A (G) represented by formula (2e) below;
- wherein the oil agent satisfies conditions (a) and (b) below;

Condition (a): the mass ratio of the total content of hydroxybenzoate (A), amino-modified silicone (H) and organic compound (X) to the content of amino-modified silicone (H) [(H)/[(A)+(H)+(X)]] is 0.05 to 0.8; and Condition (b): the mass ratio of the total content of hydroxybenzoate (A) and organic compound (X) to the content of hydroxybenzoate (A) [(A)/[(A)+(X)]] is 0.1 to 0.8.

[chem 3]

(1b)

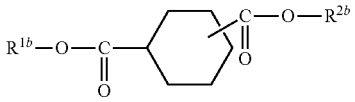

In formula (1b), $R^{1b}$ and $R^{2b}$ are each independently a C8 to C22 hydrocarbon group.

[chem 4]

(2b)

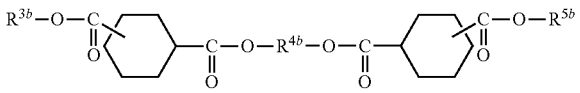

In formula (2b), $R^{3b}$ and $R^{5b}$ are each independently a C8 to C22 hydrocarbon group, and $R^{4b}$ is a C2 to C10 hydrocarbon group or residue obtained by removing two hydroxy groups from a polyoxyalkylene glycol consisting of a C2 to C4 oxyalkylene group.

[chem 5]

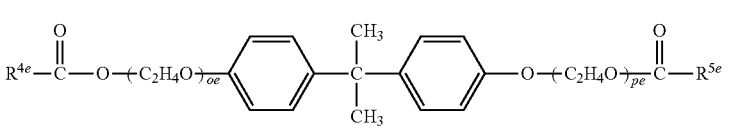

(2e)

In formula (2e), $R^{4e}$ and $R^{5e}$ are each independently a C7 to C21 hydrocarbon group, and "oe" and "pe" are independently any number of 1 to 5.

(3) The oil agent for carbon-fiber-precursor acrylic fibers according to (2), in which the mass ratio [(H)/[(A)+(H)+(X)]] is 0.2 to 0.8.

(4) The oil agent for carbon-fiber-precursor acrylic fibers according to (2), in which the mass ratio [(H)/[(A)+(H)+(X)]] is 0.4 to 0.8.

(5) The oil agent for carbon-fiber-precursor acrylic fibers according to (2), in which the mass ratio [(H)/[(A)+(H)+(X)]] is 0.5 to 0.8.

(6) An oil agent composition for carbon-fiber-precursor acrylic fibers, containing the oil agent for carbon-fiber-precursor acrylic fibers according to any of (1) to (5) as well as a nonionic surfactant.

(7) The oil agent composition for carbon-fiber-precursor acrylic fibers according to (6), in which the nonionic surfactant is contained at 10 to 100 parts by mass relative to 100 parts by mass of the oil agent for carbon-fiber-precursor acrylic fibers.

(8) An oil-treatment-liquid for carbon-fiber-precursor acrylic fibers, in which the oil agent composition for carbon-fiber-precursor acrylic fibers according to (6) or (7) is dispersed in water.

(9) In another aspect of the present invention, relative to its entire mass, the oil agent composition for carbon-fiber-precursor acrylic fibers according to (6) or (7) may contain the hydroxybenzoate (A) at 10 to 40 mass %, the amino-modified silicone (H) at 5 to 25 mass %, and the cyclohexanedicarboxylate (C) at 10 to 40 mass %.

(10) In the oil agent composition for carbon-fiber-precursor acrylic fibers according to any of (6), (7) and (9), the ratio of the total mass of hydroxybenzoate (A) and cyclohexanedicarboxylate (C) to the mass of amino-modified silicone (H) [(H)/[(A)+(C)]] may be 1/16 to 3/5.

(11) In yet another aspect of the present invention, relative to its entire mass, the oil agent composition for carbon-fiber-precursor acrylic fibers according to (6) or (7) may contain the hydroxybenzoate (A) at 10 to 40 mass %, the amino-modified silicone (H) at more than 25 and less than or equal to 60 mass %, and the cyclohexanedicarboxylate (C) at 10 to 40 mass %.

(12) In the oil agent composition for carbon-fiber-precursor acrylic fibers according to any of (6), (7) and (11), the ratio of the total mass of hydroxybenzoate (A) and cyclohexanedicarboxylate (C) to the mass of amino-modified silicone (H) [(H)/[(A)+(C)]] may be more than 3/5 and less than or equal to 3/1.

(13) A carbon-fiber-precursor acrylic fiber bundle with an applied oil agent for carbon-fiber-precursor acrylic fibers, wherein the oil agent contains

- hydroxybenzoate (A) represented by formula (1a) below;
- amino-modified silicone (H) represented by formula (3e) below; and
- an organic compound (X), which has affinity with the hydroxybenzoate (A) and a residual mass rate (R1) of 70 to 100 mass % at 300° C. measured by thermogravimetry in air, and which is liquid at 100° C.

[chem 6]

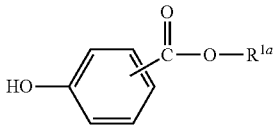

(1a)

In formula (1a), $R^{1a}$ is a C8 to C20 hydrocarbon group.

[chem 7]

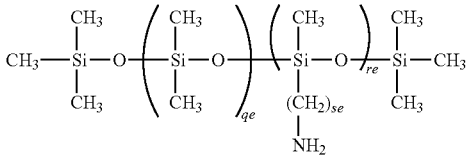

(3e)

In formula (3e), "qe" and "re" are any number of 1 or greater, "se" is any number of 1 to 5, and the dimethylsiloxane units and methylaminoalkyl-siloxane units are in a random sequence.

(14) The carbon-fiber-precursor acrylic fiber bundle according to (13), in which the organic compound (X) is at least one type selected from a group of types consisting of

- a cyclohexanedicarboxylate (B) represented by formula (1b) below,
- a cyclohexanedicarboxylate (C) represented by formula (2b) below, and
- a fatty acid ester of polyoxyethylene bisphenol A (G) represented by formula (2e) below, wherein the oil agent for carbon-fiber-precursor acrylic fibers satisfies conditions (a) and (b) below, Condition (a): the mass ratio of the total content of hydroxybenzoate (A), amino-modified silicone (H) and organic compound (X) to the content of amino-modified silicone (H) [(H)/[(A)+(H)+(X)]] is 0.05 to 0.8; and Condition (b): the mass ratio of the total content of hydroxybenzoate (A) and organic compound (X) to the content of hydroxybenzoate (A) [(A)/[(A)+(X)]] is 0.1 to 0.8.

[chem 8]

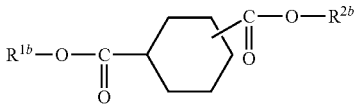

(1b)

In formula (1b), $R^{1b}$ and $R^{2b}$ are each independently a C8 to C22 hydrocarbon group.

[chem 9]

(2b)

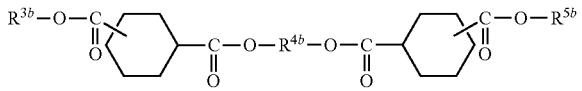

In formula (2b), $R^{3b}$ and $R^{5b}$ are each independently a C8 to C22 hydrocarbon group, and $R^{4b}$ is a C2 to C10 hydrocarbon group or residue obtained by removing two hydroxy groups from a polyoxyalkylene glycol consisting of a C2 to C4 oxyalkylene group.

[chem 10]

(2e)

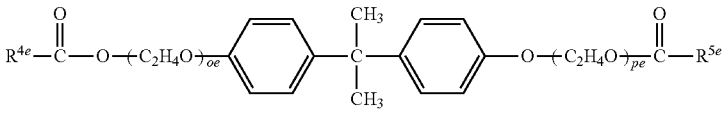

In formula (2e), $R^{4e}$ and $R^{5e}$ are each independently a C7 to C21 hydrocarbon group, and "oe" and "pe" are independently any number of 1 to 5.

(15) The carbon-fiber-precursor acrylic fiber bundle according to (14), in which the mass ratio [(H)/[(A)+(H)+(X)]] is 0.2 to 0.8.

(16) The carbon-fiber-precursor acrylic fiber bundle according to (14), in which the mass ratio [(H)/[(A)+(H)+(X)]] is 0.4 to 0.8.

(17) The carbon-fiber-precursor acrylic fiber bundle according to (14), in which the mass ratio [(H)/[(A)+(H)+(X)]] is 0.5 to 0.8.

(18) The carbon-fiber-precursor acrylic fiber bundle according to any of (13) to (17), to which a nonionic surfactant is further adhered.

(19) In yet another aspect of the present invention, the carbon-fiber-precursor acrylic fiber bundle according to any of (13) to (18) is preferred to be composed of at least 55000 single fibers.

(20) In yet another aspect of the present invention, the amount of nonionic surfactant adhered to the carbon-fiber-precursor acrylic fiber bundle according to (18) may be set at 0.20 to 0.40 mass % of dry fiber mass of a carbon-fiber-precursor acrylic fiber bundle.

(21) In yet another aspect of the present invention, relative to the dry fiber mass of the carbon-fiber-precursor acrylic fiber bundle according to (18), the adhesion amount of hydroxybenzoate (A) may be set at 0.10 to 0.40 mass %, the adhesion amount of amino-modified silicone (H) at 0.05 to 0.20 mass %, and the adhesion amount of cyclohexanedicarboxylate (C) at 0.10 to 0.40 mass %.

(22) In the carbon-fiber-precursor acrylic fiber bundle according to (14) or (21), the mass ratio of the total adhesion amount of hydroxybenzoate (A) and cyclohexanedicarboxylate (C) to the adhesion amount of amino-modified silicone (H) [(H)/[(A)+(C)]] may be 1/16 to 3/5.

(23) In yet another aspect of the present invention, relative to the dry fiber mass of the carbon-fiber-precursor acrylic fiber bundle according to (18), the adhesion amount of hydroxybenzoate (A) may be set at 0.10 to 0.40 mass %, the adhesion amount of amino-modified silicone (H) at more than 0.20 and less than or equal to 0.60 mass %, and the adhesion amount of cyclohexanedicarboxylate (C) at 0.10 to 0.40 mass %.

(24) In the carbon-fiber-precursor acrylic fiber bundle according to (14) or (23), the mass ratio of the total adhesion amount of hydroxybenzoate (A) and cyclohexanedicarboxylate (C) to the adhesion amount of amino-modified silicone (H) [(H)/[(A)+(C)]] may be more than 3/5 and less than or equal to 3/1.

Effects of the Invention

According to the present invention, an oil agent for carbon-fiber-precursor acrylic fibers, an oil agent composition for carbon-fiber-precursor acrylic fibers, and an oil-treatment-liquid for carbon-fiber-precursor acrylic fibers which effectively prevent fusion among single fibers and suppress a reduction in operational efficiency during the production process of carbon-fiber bundles are provided to produce carbon-fiber-precursor acrylic fiber bundles which exhibit excellent bundling properties and to produce carbon-fiber bundles with excellent mechanical properties at high yield. Moreover, the oil agent is easily emulsified even with a low emulsifier content.

Also, according to the present invention, carbon-fiber-precursor acrylic fiber bundles which exhibit excellent bundling properties and operational efficiency and which effectively prevent fusion among single fibers during the production process of carbon-fiber bundles are provided to produce carbon-fiber bundles with excellent mechanical properties at high yield. Moreover, the oil agent used for the production of the carbon-fiber-precursor acrylic fiber bundles is easily emulsified even with a low emulsifier content.

MODE TO CARRY OUT THE INVENTION

The present invention is described in detail below.

[Oil Agent for Carbon-Fiber-Precursor Acrylic Fiber]

The oil agent for carbon-fiber-precursor acrylic fibers related to the present invention (hereinafter may also be referred to simply as "oil agent") contains as its essential components hydroxybenzoate (A), amino-modified silicone (H) and organic compound (X), which are described below. The oil agent is applied on a carbon-fiber-precursor acrylic fiber bundle that has not yet received oil treatment.

In the present application, a pre-oil-treated carbon-fiber-precursor fiber bundle made of acrylic fibers (carbon-fiber-precursor acrylic fiber bundle) is referred to as a "precursor-fiber bundle."

<Hydroxybenzoate (A)>

Hydroxybenzoate (A) is represented by formula (1a) below.

[chem 11]

(1a)

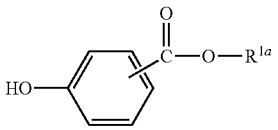

In formula (1a), $R^{1a}$ is a C8 to C20 hydrocarbon group. When the number of carbon atoms in $R^{1a}$ is eight or higher, the thermal stability of a hydroxybenzoate is maintained well, and excellent fusion prevention effects are obtained during the stabilization process. When the number of carbon atoms is 20 or lower, the hydroxybenzoate will not become excessively viscous and is unlikely to solidify. Accordingly, it is easier to prepare an emulsion of the oil agent composition containing the hydroxybenzoate, and such an oil agent homogeneously adheres to a precursor-fiber bundle.

The compound represented by the structure shown in formula (1a) above is obtained through esterification reactions of a hydroxybenzoic acid and a C8 to C20 monohydric aliphatic alcohol.

Thus, $R^{1a}$ in formula (1a) is derived from a C8 to C20 monohydric aliphatic alcohol. As for $R^{1a}$, it may be any of a C8 to C20 linear or branched-chain alkyl, alkenyl or alkynyl group. The number of carbon atoms in $R^{1a}$ is preferred to be 11 to 20, more preferably 14 to 20.

Examples of the alkyl group are n- and iso-octyl groups, 2-ethylhexyl group, n- and iso-nonyl groups, n- and iso-decyl groups, n- and iso-undecyl groups, n- and iso-dodecyl groups, n- and iso-tridecyl groups, n- and iso-tetradecyl groups, n- and iso-hexadecyl groups, n- and iso-heptadecyl groups, octadecyl group, nonadecyl group, icocyl group, and the like.

Examples of the alkenyl group are octenyl group, nonenyl group, decenyl group, undecenyl group, dodecenyl group, tetradecenyl group, pentadecenyl group, hexadecenyl group, heptadecenyl group, octadecenyl group, nonadecenyl group, icocenyl group, and the like.

Examples of the alkynyl group are 1- and 2-octynyl groups, 1- and 2-nonynyl groups, 1- and 2-decynyl groups, 1- and 2-undecynyl groups, 1- and 2-dodecynyl groups, 1- and 2-tridecynyl groups, 1- and 2-tetradecynyl groups, 1- and 2-hexadecynyl groups, 1- and 2-octadecynyl groups, 1- and 2-nonadecynyl groups, 1- and 2-eicocynyl groups, and the like.

A hydroxybenzoate is obtained through condensation reactions of a hydroxybenzoic acid and a C8 to C20 monohydric aliphatic alcohol without using a catalyst or in the presence of a known catalyst for esterification such as a tin compound or titanium compound. Condensation reactions are preferred to be conducted in an inert gas atmosphere. Reaction temperature is preferred to be 160 to 250° C., more preferably 180 to 230° C.

Regarding the molar ratio of a hydroxybenzoic acid to an alcohol component supplied for condensation reactions, it is preferred to be 0.9 to 1.3 mol, more preferably 1.0 to 1.2 mol, of a C8 to C20 monohydric aliphatic alcohol relative to 1 mol of a hydroxybenzoic acid. When a catalyst for esterification is used, from the viewpoint of fiber tensile strength, the catalyst is preferred to be deactivated after condensation reactions and removed using an adsorbent.

<Amino-Modified Silicone (H)>

Amino-modified silicone (H) has affinity with precursor-fiber bundles; in other words, strong interaction is exhibited between the amino group of amino-modified silicone (H) and the nitrile group in the structure of acrylic fiber. Accordingly, they are effective in improving the affinity of the oil agent for a precursor-fiber bundle and the heat resistance of the oil agent. Amino-modified silicone (H) is represented by formula (3e) below.

[chem 12]

(3e)

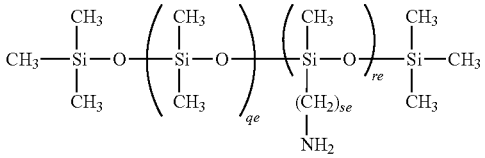

In formula (3e), "qe" and "re" are each any number of 1 or greater, "se" is any number of 1 to 5, and the dimethylsiloxane units and methylaminoalkyl-siloxane units are in a random sequence.

The "qe" of amino-modified silicone in formula (3e) is preferred to be any number of 1 or greater, more preferably 10 to 300, even more preferably 50 to 200. In addition, "re" is preferred to be any number of 1 or greater, more preferably 2 to 10, even more preferably 2 to 5. When "qe" and "re" in formula (3e) are each in the above range, sufficient heat resistance is obtained and properties of the carbon-fiber bundle are well achieved. When "qe" is 10 or greater, sufficient heat resistance is obtained and fusion among single fibers is effectively prevented. Also, when "qe" is 300 or smaller, an oil-treatment-liquid with a good stability is easier to prepare by emulsifying the oil agent, a surfactant and water. Moreover, when "re" is 2 or greater, sufficient affinity is achieved with precursor-fiber bundles, while fusion among single fibers is effectively prevented. When "re" is 10 or smaller, the oil-agent composition itself exhibits sufficient heat resistance, and fusion among single fibers is also prevented.

The "se" of amino-modified silicone in formula (3e) is preferred to be 1 to 5, more preferably the amino-modified moiety to be an aminopropyl group, that is, "se" is preferred to be 3. Note that the amino-modified silicone represented by formula (3e) may be a mixture of multiple compounds, and "qe", "re" and "se" may not be integral numbers.

In formula (3e), "qe" and "re" can be roughly estimated from the kinematic viscosity and amino equivalent weight of amino-modified silicone (H).

The "qe" and "re" are determined by first measuring the kinematic viscosity of the amino-modified silicone (H), followed by calculating the molecular weight from the measured value of the kinematic viscosity according to the A. J. Barry formula ($\log \eta = 1.00 + 0.0123\ M^{0.5}$ (η: kinematic viscosity at 25° C., M: molecular weight)). Then, from the obtained molecular weight and amino equivalent weight, "re" is determined as the average number of amino groups per 1 molecule. When the molecular weight, "re" and "se" are determined, the value of "qe" is determined accordingly.

Regarding amino-modified silicone (H), its kinematic viscosity at 25° C. is preferred to be 50 to 500 $mm^2/s$, more preferably 80 to 300 $mm^2/s$. When the kinematic viscosity is 50 $mm^2/s$ or higher, bundling properties are sufficiently provided for a precursor-fiber bundle. When the kinematic viscosity is 500 $mm^2/s$ or lower, it is easier to prepare an oil-treatment-liquid with a good stability by emulsifying the oil agent, surfactant and water.

The kinematic viscosity of amino-modified silicone (H) is determined according to "Methods for Viscosity Measurement of Liquids" specified in JIS-Z-8803, or based on ASTM D 445-46T. For example, the viscosity is measured using an Ubbelohde Viscometer.

The amino equivalent weight of amino-modified silicone (H) is preferably 2000 to 8000 g/mol and more preferably 2500 to 6000 g/mol. When the amino equivalent weight is 2000 g/mol or more, the number of amino groups in one silicone molecule will not be too high. As a result, the amino-modified silicone exhibits sufficient thermal stability, and process failure is less likely to occur during spinning and calcination steps. Meanwhile, when the amino equivalent weight is 8000 g/mol or lower, the number of amino groups in one silicone molecule is not too low. As a result, sufficient affinity with the precursor-fiber bundle is obtained, and the oil composition is adhered uniformly. When the amino equivalent weight is in the above range, affinity with a precursor-fiber bundle and thermal stability of silicone are both achieved.

<Organic Compound (X)>

Organic compound (X) is liquid at 100° C., has affinity with hydroxybenzoate (A), and its residual mass rate (R1) at 300° C. is 70 to 100 mass % measured by thermogravimetry in air. If residual mass rate (R1) is lower than 70 mass %, problems may arise during the calcination process since the compound is vaporized and cohere on wall surfaces. When residual mass rate (R1) exceeds 70 mass %, the amount of vaporized compound during calcination is sufficiently low so as not to lower operational efficiency and industrial productivity.

Residual mass rate (R1) is determined as follows.

Using a thermogravimetric analyzer with a gas flowing system (product name: Micro Thermogravimetric Analyzer TGA-50, made by Shimadzu Corporation), approximately 50 mg of organic compound (X) as a sample is placed in the analyzer at room temperature, and its initial mass is $W_3$. Then, heat is applied on the sample until it reaches 300° C. at a rate of temperature rise of 10° C./min., while air is flowed in at 200 mL/min. The residual mass of the sample at 300° C. is $W_4$. From the values of $W_3$ and $W_4$ obtained, residual mass rate (R1) is calculated from the following formula (iii).

$$\text{Residual mass rate } (R1)\ [\text{mass }\%]=(W_4/W_3)\times 100 \quad \text{(iii)}$$

Organic compound (X) is not limited to any specific type as long as it satisfies the aforementioned conditions. To reduce the vaporized amount (scattered amount) of an organic compound during the calcination process, preferred examples are compounds obtained through the reaction of a cyclohexanedicarboxylic acid and a C8 to C22 monohydric aliphatic alcohol (hereinafter may also be referred to as cyclohexanedicarboxylate (B)); compounds obtained through the reaction of cyclohexanedicarboxylic acid, a C8 to C22 monohydric aliphatic alcohol, a C2 to C10 polyhydric alcohol and/or polyoxyalkylene glycol having a C2 to C4 oxyalkylene group (hereinafter may also be referred to as cyclohexanedicarboxylate (C)); aromatic ester compounds having a bisphenol A skeleton; and the like.

(Cyclohexanedicarboxylate)

Cyclohexanedicarboxylates (B) and (C) exhibit sufficient heat resistance during the stabilization process, but no aromatic ring is contained therein. Thus, it is easier to be decomposed during the carbonization process and be exhausted from the system along with the circulating gas in the furnace. Accordingly, those compounds are unlikely to cause process failure or to decrease product quality. In addition, since cyclohexanedicarboxylates (B) and (C) are well dispersed in water through emulsification when a later-described surfactant is added, they are expected to adhere homogeneously to precursor-fiber bundles, and are effective for producing carbon-fiber-precursor acrylic fiber bundles capable of giving carbon-fiber bundles with excellent mechanical properties.

As for the cyclohexanedicarboxylic acid, 1,2-cyclohexanedicarboxylic acid, 1,3-cyclohexanedicarboxylic acid, or 1,4-cyclohexanedicarboxylic acid may be used. Among those, 1,4-cyclohexanedicarboxylic acid is preferred from the viewpoints of heat resistance properties and ease of synthesis.

The moiety of cyclohexanedicarboxylic acid in the structure of a cyclohexanedicarboxylate may be derived from a cyclohexanedicarboxylic acid, its anhydride, or its ester with a C1 to C3 short-chain alcohol. Examples of a C1 to C3 short-chain alcohol are methanol, ethanol, normal or isopropanol.

As for the alcohol as a raw material for a cyclohexanedicarboxylate, one or more alcohols may be used, selected from among monohydric aliphatic alcohols, polyhydric alcohols and polyoxyalkylene glycols.

The number of carbon atoms in a monohydric aliphatic alcohol is 8 to 22. When the number of carbon atoms is 8 or higher, the thermal stability of a cyclohexanedicarboxylate is maintained well, and sufficient fusion prevention effects are thereby exhibited during the stabilization process. When the number of carbon atoms is 22 or lower, a cyclohexanedicarboxylate does not become excessively viscous, and is unlikely to solidify. Accordingly, it is easier to prepare an emulsion of the oil agent composition containing the cyclohexanedicarboxylate, and the oil agent composition homogeneously adheres to precursor-fiber bundles.

From the viewpoint above, the number of carbon atoms in a monohydric aliphatic alcohol is preferred to be 12 to 22, more preferably 15 to 22.

Examples of the C8 to C22 monohydric aliphatic alcohol are alkyl alcohols such as octanol, 2-ethylhexanol, nonanol, decanol, undecanol, dodecanol, tridecanol, tetradecanol, hexadecanol, heptadecanol, octadenanol, nonadenanol, eicosanol, heneicosanol and docosanol; alkenyl alcohols such as octenyl alcohol, nonenyl alcohol, decenyl alcohol, undecenyl alcohol, dodecenyl alcohol, tetradecenyl alcohol, pentadecenyl alcohol, hexadecenyl alcohol, heptadecenyl alcohol, octadecenyl alcohol, nonadecenyl alcohol, icocenyl alcohol, henicocenyl alcohol, dococenyl alcohol, oleyl alcohol, gadoleyl alcohol, and 2-ethyldecenyl alcohol; alkynyl alcohols such as octynyl alcohol, nonynyl alcohol, decynyl alcohol, undecynyl alcohol, dodecynyl alcohol, tridecynyl alcohol, tetradecynyl alcohol, hexadecynyl alcohol, stearynyl alcohol, nonadecynyl alcohol, eicocynyl alcohol, henicocynyl alcohol, and dococynyl alcohol, and the like.

Especially, from the viewpoints of balancing ease of handling, processability and characteristics, oleyl alcohol is preferred since oil-treatment-liquids are easier to prepare by dispersing the oil agent composition in water, and problems seldom occur such as fibers being wound around transport rollers when in contact with transport rollers in the spinning step, while desired heat resistance is achieved. Such aliphatic alcohols may be used alone or in combination thereof.

The number of carbon atoms of a polyhydric alcohol is 2 to 10. When there are 2 or more carbon atoms, thermal stability of the cyclohexanedicarboxylate is maintained well, and sufficient fusion prevention effects are thereby exhibited during the stabilization process. When the number of carbon atoms is 10 or lower, the cyclohexanedicarboxylate does not become excessively viscous and is unlikely to solidify. Accordingly, it is easier to prepare an oil-treatment-liquid by dispersing in water the oil agent composition containing the cyclohexanedicarboxylate, and such an oil agent composition homogeneously adheres to precursor-fiber bundles.

From the viewpoints above, the number of carbon atoms of a polyhydric alcohol is preferred to be 5 to 10, more preferably 5 to 8.

A polyhydric alcohol having 2 to 10 carbon atoms may be an aliphatic alcohol, aromatic alcohol, saturated or unsaturated alcohol.

Examples of the polyhydric alcohol are dihydric alcohols such as ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 2-methyl-1,3-propanediol. 3-methyl-1,5-pentanediol, 1,5-hexanediol, 2-methyl-1,8-octanediol, neopentyl glycol, 2-isopropyl-1,4-butanediol, 2-ethyl-1,6-hexanediol, 2,4-dimethyl-1,5-pentanediol, 2,4-diethyl-1,5-pentanediol, 1,3-butanediol, 2-ethyl-1,3-hexanediol, 2-butyl-2-ethyl-1,3-propanediol, 1,3-cyclohexanediol, 1,4-cyclohexanediol, and 1,4-cyclohexanedimethanol; trihydric alcohols such as trimethylolethane, trimethylolpropane, hexanetriol, glycerin, and so forth. Among those, dihydric alcohols are preferred, since the viscosity of the oil agent is lowered and the oil agent is adhered on precursor-fiber bundles homogeneously.

Polyoxyalkylene glycols have a repeating unit of a C2 to C4 oxyalkylene group, along with two hydroxy groups. Hydroxy groups are preferred to be positioned at both terminals.

When there are 2 or more carbon atoms in the oxyalkylene group, the thermal stability of the cyclohexanedicarboxylate is maintained well, and sufficient fusion prevention effects are thereby exhibited during the stabilization process. When the number of carbon atoms of the oxyalkylene group is 4 or lower, the cyclohexanedicarboxylate does not become excessively viscous and is unlikely to solidify. Accordingly, it is easier to prepare an oil-treatment-liquid by dispersing in water the oil agent composition containing the cyclohexanedicarboxylate, and such an oil agent composition homogeneously adheres to precursor-fiber bundles.

Examples of a polyoxyalkylene glycol are polyoxyethylene glycol, polyoxypropylene glycol, polyoxytetramethylene glycol, polyoxybutylene glycol and the like. The average number of repetition of oxyalkylene groups is preferred to be 1 to 15, more preferably 1 to 10, even more preferably 2 to 8, from the viewpoint of lowering the viscosity of the oil agent so as to homogeneously adhere the oil agent to fibers.

It is an option to use both a C2 to C10 polyhydric alcohol and a polyoxyalkylene glycol with a C2 to C4 oxyalkylene group, or to use either one.

As for cyclohexanedicarboxylate (B), a compound with the structure represented by formula (1b) below is preferred, and as for cyclohexanedicarboxylate (C), a compound represented by formula (2b) below is preferred.

[chem 13]

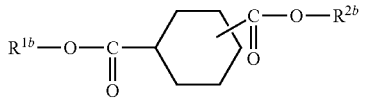

(1b)

[chem 14]

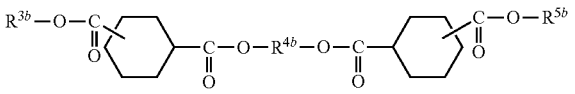

(2b)

In formula (1b), $R^{1b}$ and $R^{2b}$ are each independently a C8 to C22 hydrocarbon group. When the number of carbon atoms in $R^{1b}$ and $R^{2b}$ is 8 or higher, the thermal stability of cyclohexanedicarboxylate (B) is maintained well and thus fusion prevention effects are sufficiently exhibited during the stabilization process. When the number of carbon atoms in $R^{1b}$ and $R^{2b}$ is 22 or lower, cyclohexanedicarboxylate (B) does not become excessively viscous and is unlikely to solidify. Accordingly, an oil-treatment-liquid is easier to prepare by dispersing in water the oil agent composition containing cyclohexanedicarboxylate (B), and such an oil agent composition is adhered homogeneously to a precursor-fiber bundle. From such viewpoints, the number of carbon atoms in $R^{1b}$ and $R^{2b}$ is preferred to be 12 to 22, more preferably 15 to 22.

$R^{1b}$ and $R^{2b}$ may be structured the same as or different from each other.

A compound with the structure represented by formula (1b) is a cyclohexanedicarboxylate obtained through esterification reactions of a cyclohexanedicarboxylic acid and a C8 to C22 monohydric aliphatic alcohol. Thus, $R^{1b}$ and $R^{2b}$ in formula (1b) are each derived from an aliphatic alcohol. $R^{1b}$ and $R^{2b}$ may each be any of a C8 to C22 linear or branched-chain alkyl, alkenyl or alkynyl groups.

Examples of the alkyl group are n- and iso-octyl groups, 2-ethylhexyl group, n- and iso-nonyl groups, n- and iso-decyl groups, n- and iso-undecyl groups, n- and iso-dodecyl groups, n- and iso-tridecyl groups, n- and iso-tetradecyl groups, n- and iso-hexadecyl groups, n- and iso-heptadecyl groups, octadecyl group, nonadecyl group, eicocyl group, henicocyl group, dococyl group, and the like.

Examples of the alkenyl group are octenyl group, nonenyl group, decenyl group, undecenyl group, dodecenyl group, tetradecenyl group, pentadecenyl group, hexadecenyl group, heptadecenyl group, octadecenyl group, nonadecenyl group, icocenyl group, henicocenyl group, dococenyl group, oleyl group, gadoleyl group, 2-ethyldecenyl group, and the like.

Examples of the alkynyl group are 1- and 2-octynyl groups, 1- and 2-nonynyl groups, 1- and 2-decynyl groups, 1- and 2-undecynyl groups, 1- and 2-dodecynyl groups, 1- and 2-tridecynyl groups, 1- and 2-tetradecynyl groups, 1- and 2-hexadecynyl groups, 1- and 2-stearynyl groups, 1- and 2-nonadecynyl groups, 1- and 2-eicocynyl groups, 1- and 2-henicocynyl groups, 1- and 2-dococynyl groups, and the like.

A cyclohexanedicarboxylate (B) is obtained through condensation reactions of a cyclohexanedicarboxylic acid and a C8 to C22 monohydric aliphatic alcohol without using a catalyst or in the presence of a known catalyst for esterification such as a tin compound or titanium compound. Condensation reactions are preferred to be conducted in an inert gas atmosphere.

Reaction temperature is preferred to be 160 to 250° C., more preferably 180 to 230° C.

Regarding the molar ratio of a carboxylic acid component and an alcohol component supplied for condensation reactions, it is preferred to be 1.8 to 2.2 mol, more preferably 1.9 to 2.1 mol, of a C8 to C22 monohydric aliphatic alcohol relative to 1 mol of a cyclohexanedicarboxylic acid. When an esterification catalyst is used, from the viewpoint of fiber tensile strength, the catalyst is preferred to be deactivated after condensation reactions and removed using an adsorbent.

Meanwhile, in formula (2b), $R^{3b}$ and $R^{5b}$ are each independently a C8 to C22 hydrocarbon group. $R^{4b}$ is a C2 to C10 hydrocarbon group or a divalent residue obtained by removing two hydroxyl groups from a polyoxyalkylene glycol having a C2 to C4 oxyalkylene group.

Regarding $R^{3b}$ and $R^{5b}$, when the number of carbon atoms is 8 or higher, the thermal stability of cyclohexanedicarboxylate (C) is maintained well, and sufficient fusion prevention effects are exhibited during the stabilization process. When the number of carbon atoms in $R^{3b}$ and $R^{5b}$ is 22 or lower, cyclohexanedicarboxylate (C) does not become excessively viscous and is unlikely to solidify. Accordingly, an oil-treatment-liquid is easier to prepare by dispersing in water the oil agent composition containing cyclohexanedicarboxylate (C), and the oil agent composition homogeneously adheres to a precursor-fiber bundle. From such viewpoints, the number of carbon atoms in $R^{3b}$ and $R^{5b}$ is preferred to be 12 to 22, more preferably 15 to 22.

$R^{3b}$ and $R^{5b}$ may be structured the same as or different from each other.

In addition, when $R^{4b}$ is a hydrocarbon group having at least 2 carbon atoms, or when $R^{4b}$ is a divalent residue obtained by removing two hydroxy groups from a polyoxyalkylene glycol and when the number of carbon atoms in the oxyalkylene group of the divalent residue is at least two, $R^{4b}$ will be esterified with the carboxylic acid added to a cyclohexane ring, thus crosslinking cyclohexane rings. Accordingly, a substance with high thermal stability is easier to achieve. On the other hand, when $R^{4b}$ is a hydrocarbon group having no greater than 10 carbon atoms, or when $R^{4b}$ is a divalent residue obtained by removing two hydroxy groups from polyoxyalkylene glycol and when the number of carbon atoms in the oxyalkylene group of the divalent residue is no higher than 4, cyclohexanedicarboxylate (C) does not become excessively viscous and is unlikely to solidify. Accordingly, an oil-treatment-liquid is easier to prepare by dispersing in water the oil agent composition containing cyclohexanedicarboxylate (C), and the oil agent composition homogeneously adheres to a precursor-fiber bundle.

When $R^{4b}$ is a hydrocarbon group, the number of carbon atoms is preferred to be 5 to 10, and when $R^{4b}$ is a divalent residue obtained by removing two hydroxy groups from a polyoxyalkylene glycol, the number of carbon atoms in the oxyalkylene group of the divalent residue is preferred to be 4.

Cyclohexanedicarboxylate (C) is obtained through condensation reactions of a cyclohexanedicarboxylic acid, a C8 to C22 monohydric aliphatic alcohol and a C2 to C10 polyhydric alcohol; or obtained through condensation reactions of a cyclohexanedicarboxylic acid, a C8 to C22 monohydric aliphatic alcohol and a polyoxyalkylene glycol having a C2 to C4 oxyalkylene group. Thus, in formula (2b), $R^{3b}$ and $R^{5b}$ are derived from aliphatic alcohols. As for $R^{3b}$ and $R^{5b}$, they may be a linear or branched-chain alkyl, alkenyl or alkynyl group. Such alkyl, alkenyl and alkynyl groups are the same as the alkyl, alkenyl and alkynyl groups listed earlier in the description of $R^{1b}$ and $R^{2b}$ in formula (1b).

$R^{3b}$ and $R^{5b}$ may be structured the same as or different from each other.

On the other hand, $R^{4b}$ is derived from a C2 to C10 polyhydric alcohol or a polyoxyalkylene glycol having a C2 to C4 oxyalkylene group.

When $R^{4b}$ is derived from a C2 to C10 polyhydric alcohol, $R^{4b}$ is preferred to be a saturated or unsaturated linear or branched-chain divalent hydrocarbon group. Particularly preferred is a substituent obtained by detaching one hydrogen atom from any carbon atom in an alkyl, alkenyl or alkynyl group. The number of carbon atoms is preferred to be 5 to 10, more preferably 5 to 8, as described above.

Examples of the alkyl group are ethyl group, propyl group, butyl group, pentyl group, hexyl group, n- and iso-heptyl groups, n- and iso-octyl groups, 2-ethylhexyl group, n- and iso-nonyl groups, n- and iso-decyl groups, and the like.

Examples of the alkenyl group are ethenyl group, propenyl group, butenyl group, pentenyl group, hexenyl group, heptenyl group, octenyl group, nonenyl group, decenyl group, and the like.

Examples of the alkynyl group are ethynyl group, propynyl group, butynyl group, pentynyl group, hexynyl group, heptynyl group, octynyl group, nonynyl group, decynyl group, and the like.

On the other hand, when $R^{4b}$ is derived from a polyoxyalkylene glycol, $R^{4b}$ is a divalent residue obtained by removing two hydroxy groups from a polyoxyalkylene glycol, in particular, represented by $—(OA)_{pb-1}$-A- (here, "OA" indicates a C2 to C4 oxyalkylene group, "A" indicates a C2 to C4 alkylene group, and "pb" is the number of oxyalkylene groups contained in one molecule of polyoxyalkylene glycol.) For "pb," 1 to 15 is preferred, more preferably 1 to 10, even more preferably 2 to 8. Examples of the oxyalkylene group are oxyethylene group, oxypropylene group, oxytetramethylene group, oxybutylene group, and the like.

Conditions for condensation reactions to produce cyclohexanedicarboxylate (C) are the same as those described above.

From the viewpoint of suppressing side reactions, the carboxylic acid component and the alcohol component supplied for condensation reactions are preferred to have the following molar ratio: relative to 1 mol of a cyclohexanedicarboxylic acid, preferably 0.8 to 1.6 mol of a C8 to C22 monohydric aliphatic alcohol and 0.2 to 0.6 mol of a C2 to C10 polyhydric alcohol and/or a polyoxyalkylene glycol having a C2 to C4 oxyalkylene group; more preferably, 0.9 to 1.4 mol of a C8 to C22 monohydric aliphatic alcohol and 0.3 to 0.55 mol of a C2 to C10 polyhydric alcohol and/or a polyoxyalkylene glycol having a C2 to C4 oxyalkylene group; even more preferably, 0.9 to 1.2 mol of a C8 to C22 monohydric aliphatic alcohol and 0.4 to 0.55 mol of a C2 to C10 polyhydric alcohol and/or a polyoxyalkylene glycol having a C2 to C4 oxyalkylene group.

In addition, in the alcohol component to be supplied for condensation reactions, the ratio of the amount of C8 to C22 monohydric aliphatic alcohol to the total amount of C2 to C10 polyhydric alcohol and polyoxyalkylene glycol having a C2 to C4 oxyalkylene group is as follows: relative to 1 mol of C8 to C22 monohydric aliphatic alcohol, the sum of C2 to C10 polyhydric alcohol and polyoxyalkylene glycol having a C2 to C4 oxyalkylene group is preferred to be 0.1 to 0.6 mol, more preferably 0.2 to 0.6 mol, even more preferably 0.4 to 0.6 mol.

When an organic compound (X) is selected from cyclohexanedicarboxylates (B) and (C), especially preferred is a cyclohexanedicarboxylate with the structure represented by formula (2b) above, because it does not vaporize during the stabilization process and remains stable on the surface of a precursor-fiber bundle.

Here, the number of cyclohexyl rings in one molecule is preferred to be 1 or 2 because the viscosity of the obtained oil agent composition is lower, thus making it easier to disperse in water and leading to an emulsion with excellent stability.

(Aromatic Ester Compound)

Examples of an aromatic ester compound having a bisphenol A skeleton are polyoxyethylene bisphenol A diacrylate, polyoxypropylene bisphenol A diacrylate, fatty acid esters of polyoxyethylene bisphenol A, fatty acid esters of polyoxypropylene bisphenol A, polyoxyethylene bisphenol A dimethacrylate, polyoxypropylene bisphenol A dimethacrylate, bisphenol A ethylene glycolate diacetate, bisphenol A glycerolate diacetate, and the like. Among them, a fatty acid ester (G) of polyoxyethylene bisphenol A represented by formula (2e) below is preferred since it exhibits especially excellent heat resistance.

[chem 15]

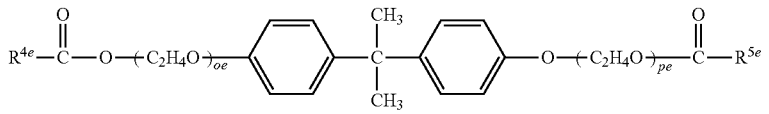

(2e)

In formula (2e), $R^{4e}$ and $R^{5e}$ are each independently a C7 to C21 hydrocarbon group. When the number of carbon atoms in the hydrocarbon group is at least 7, excellent heat resistance is maintained in polyoxyethylene bisphenol A-fatty acid ester (G), and sufficient fusion prevention effects are exhibited during the stabilization process. When the number of carbon atoms in the hydrocarbon group is 21 or lower, an oil-treatment-liquid is easier to prepare by dispersing in water the oil agent composition containing polyoxyethylene bisphenol A-fatty acid ester (G), and the oil agent composition adheres homogeneously to a precursor-fiber bundle. As a result, sufficient fusion prevention effects are exhibited during the stabilization process while the bundling properties of a carbon-fiber-precursor acrylic fiber bundle are enhanced. The number of carbon atoms in the hydrocarbon group is preferred to be 9 to 15, more preferably 11.

$R^{4e}$ and $R^{5e}$ may be structured the same as or different from each other.

As the hydrocarbon group, saturated hydrocarbon groups, especially straight-chain saturated hydrocarbon groups, are preferred. Specific examples are alkyl groups such as heptyl groups, octyl groups, nonyl groups, decyl groups, undecyl groups, lauryl groups (dodecyl groups), tridecyl groups, tetradecyl groups, pentadecyl groups, hexadecyl groups, heptadecyl groups, octadecyl groups, nonadecyl groups, icosyl groups (eicosyl groups), henicosyl groups (heneicosyl groups) and the like.

In formula (2e), "oe" and "pe" are independently 1 to 5. When "oe" and "pe" exceed the above range, the heat resistance of polyoxyethylene bisphenol A-fatty acid ester (G) is lowered, and single fibers may be fused during the stabilization process.

Polyoxyethylene bisphenol A-fatty acid ester (G) represented by formula (2e) may be a mixture of multiple compounds. Thus, "oe" and "pe" may not be integral numbers. In addition, a hydrocarbon group that forms $R^{4e}$ and $R^{5e}$ may be one type or may be a mixture of multiple types.

<Content>

An oil agent is preferred to satisfy conditions (a) and (b) below.

Condition (a): the mass ratio of the total content of hydroxybenzoate (A), amino-modified silicone (H) and organic compound (X) to the content of amino-modified silicone (H) [(H)/[(A)+(H)+(X)]] is 0.05-0.8.

Condition (b): the mass ratio of the total content of hydroxybenzoate (A) and organic compound (X) to the content of hydroxybenzoate (A) [(A)/[(A)+(X)]] is 0.1-0.8.

In condition (a), the mass ratio [(H)/[(A)+(H)+(X)]] is set at 0.05-0.8, preferably 0.2-0.8, more preferably 0.4-0.8, even more preferably 0.5-0.8. When the mass ratio is 0.05 or greater, process stability is fully maintained during spinning and calcination steps, and when the ratio is 0.8 or lower, formation of silicon compounds such as silicon oxide, silicon carbide and silicon nitride during the calcination process is sufficiently lowered.

In condition (b), the mass ratio [(A)/[(A)+(X)]] is 0.1-0.8, preferably 0.3-0.8, more preferably 0.5-0.8. When the mass ratio is at least 0.1, sufficient fusion prevention effects are obtained during the stabilization process, ultimately resulting in high quality in a carbon-fiber bundle. When the ratio is 0.8 or lower, it is easier to prepare an oil-treatment-liquid by dispersing the oil agent composition in water.

<Form of Oil Agent>

Prior to being applied to a precursor-fiber bundle, the oil agent is preferred to be mixed with a surfactant to make an oil agent composition, which is then dispersed in water to form an oil-treatment-liquid so as to apply the oil agent to the precursor-fiber bundle even more homogeneously.

In the following, examples of an oil agent composition for carbon-fiber-precursor acrylic fibers are described.

<Oil Agent Composition for Carbon-Fiber-Precursor Acrylic Fiber>

The oil agent composition for carbon-fiber-precursor acrylic fibers according to the present invention (hereinafter simply referred to as "oil agent composition") contains the above-described oil agent related to the present invention and a surfactant.

Regarding the content of each component of the oil agent composition, the content of cyclohexanedicarboxylate (C) is preferred to be 10 to 40 mass %, more preferably 15 to 35 mass %, even more preferably 20 to 30 mass %, relative to the entire mass of the oil agent composition. When the content of cyclohexanedicarboxylate (C) is at least 10 mass %, hydroxybenzoate (A) is homogeneously applied to a precursor-fiber bundle. When the content is 40 mass % or lower, the heat resistance of the oil agent is well maintained so that fusion among single fibers during the stabilization process is effectively prevented.

The content of hydroxybenzoate (A) is preferred to be 10 to 40 mass %, more preferably 15 to 35 mass %, even more preferably 20 to 30 mass %, relative to the entire mass of the oil agent composition. When the content of hydroxybenzoate (A) is at least 10 mass %, the heat resistance of the oil agent improves, thus effectively preventing fusion among single fibers during the stabilization process. When the content is 40 mass % or lower, uneven distribution of hydroxybenzoate (A) is prevented when the oil composition is applied to a precursor-fiber bundle.

To obtain a carbon fiber with excellent mechanical properties, the mass ratio of hydroxybenzoate (A) to cyclohexanedicarboxylate (C) [(C)/(A)] is preferred to be 1/5 to 5/1, more preferably 1/4 to 4/1, even more preferably 1/3 to 3/1.

The content of amino-modified silicone (H) is preferred to be 5 to 25 mass %, more preferably 5 to 20 mass %, even more preferably 10 to 20 mass %, relative to the entire mass of the oil agent composition. When the content of amino-modified silicone (H) is at least 5 mass %, it is easier to prevent fusion among single fibers, while the obtained carbon fiber exhibits excellent mechanical properties. When the content is 25 mass % or lower, problems caused by inorganic silicon compounds formed during the stabilization process are less likely to occur and operational efficiency is thereby less likely to be lowered.

In the above, the ratio of the total mass of cyclohexanedicarboxylate (C) and hydroxybenzoate (A) to the mass of amino-modified silicone (H) [(H)/[(A)+(C)]] is preferred to be 1/16 to 3/5, more preferably 1/15 to 1/2, even more preferably 1/15 to 2/5 in order to obtain carbon fibers with excellent mechanical properties.

The content of amino-modified silicone (H) may also be set at more than 25 and less than or equal to 60 mass % relative to the total mass of the oil agent composition. With such a setting, to obtain carbon fibers with excellent mechanical properties, the ratio of the total mass of cyclohexanedicarboxylate (C) and hydroxybenzoate (A) to the mass of amino-modified silicone (H) [(H)/[(A)+(C)]] is preferred to be set at more than 3/5 and less than or equal to 3/1. By so setting, the content of at least either of the high-cost cyclohexanedicarboxylate (C) and hydroxybenzoate (A) may be reduced within a range that does not decrease the effects of the oil agent. As a result, while the cost of raw materials for oil agent compositions is reduced, high mechanical properties are achieved without experiencing process failure caused by inorganic silicon compounds formed during the calcination process.

(Surfactant)

The content of a surfactant is preferred to be 10 to 100 parts by mass, more preferably 20 to 75 parts by mass, relative to 100 parts by mass of the oil agent. When the content of a surfactant is at least 20 parts by mass, it is easier to emulsify the oil agent, and a stable emulsion is thereby obtained. When the content of a surfactant is no greater than 75 parts by mass, the bundling properties of a precursor-fiber bundle with the oil agent composition applied thereon are prevented from decreasing. In addition, when a carbon-fiber bundle is obtained by calcinating the precursor-fiber bundle, its mechanical properties are less likely to be lowered.

Relative to the entire mass of an oil agent composition, the content of a surfactant is preferred to be 20 to 40 mass %, more preferably 30 to 40 mass %.

Various known substances may be used as a surfactant, but especially preferred to be used in oil agents for carbon-fiber-precursor acrylic fibers are nonionic surfactants. The nonionic surfactants include, for example, polyethylene glycol-based nonionic surfactants such as ethylene oxide adducts of higher alcohols, ethylene oxide adducts of alkylphenols, aliphatic ethylene oxide adducts, ethylene oxide adducts of aliphatic polyhydric alcohol esters, ethylene oxide adducts of higher alkylamines, ethylene oxide adducts of aliphatic amides, ethylene oxide adducts of fats and oils, and ethylene oxide adducts of polypropylene glycols; polyhydric alcohol-based nonionic surfactants such as aliphatic esters of glycerol, aliphatic esters of pentaerythritol, aliphatic esters of sorbitol, aliphatic esters of sorbitan, aliphatic esters of sucrose, alkyl ethers of polyhydric alcohols, and fatty amides of alkanolamines; and so on. These surfactants may be used alone or in combination thereof.

Preferred nonionic surfactants are polyether block copolymers structured to have propylene oxide (PO) units and ethylene oxide (EO) units as shown in formula (4e) below and/or polyoxyethylene alkyl ether structured to have EO units as shown in formula (5e) below.

[chem 16]

$$R^{6e}-O-(C_2H_4O)_{xe}-(C_3H_6O)_{ye}-(C_2H_4O)_{ze}-R^{7e} \quad (4e)$$

[chem 17]

$$R^{8e}-O-(C_2H_4O)_{te}-H \quad (5e)$$

In formula (4e), $R^{6e}$ and $R^{7e}$ are each independently a hydrogen atom, or a C1 to C24 hydrocarbon group. Hydrocarbon groups may be structured to be linear or branched chain.

$R^{6e}$ and $R^{7e}$ are each determined in consideration of balancing EO and PO along with other components of the oil agent composition; they are each preferred to be a hydrogen atom or a C1 to C5 linear or branched-chain alkyl group, preferably a hydrogen atom.

In formula (4e), "xe" and "ze" are the average number of added moles of EO, and "ye" is the average number of added moles of PO.

The numbers of "xe," "ye," and "ze" are each independently 1 to 500, preferably 20 to 300.

Also, the ratio of the sum of "xe" and "ze" to "ye" (xe+ze:ye) is preferred to be 90:10 to 60:40.

Polyether block copolymers are preferred to have a number average molecular weight of 3000 to 20000. When the number average molecular weight is in such a range, thermal stability and dispersibility in water required for an oil agent composition are both achieved.

Moreover, the kinematic viscosity of a polyether block copolymer at 100° C. is preferred to be 300 to 15000 $mm^2/s$. When the kinematic viscosity is in such a range, the oil agent composition is prevented from excessive infiltration into the fiber, while the oil agent composition seldom causes problems derived from high viscosity, such as single fibers being wound around transport rollers or the like during a drying process after the oil agent composition is applied to a precursor-fiber bundle.

The kinematic viscosity of a polyether block copolymer is measured according to "Methods for Viscosity Measurement of Liquids" specified in JIS-Z-8803, or based on ASTM D 445-46T. For example, the viscosity is measured using an Ubbelohde viscometer.

In formula (5e), $R^{8e}$ is a C10 to C20 hydrocarbon group. When the number of carbon atoms is 10 or higher, thermal stability of the oil agent composition is sufficient, and appropriate lipophilicity is easier to obtain. When the number of carbon atoms is 20 or lower, the viscosity of the oil agent composition will not be excessive, and the oil agent composition remains liquid. Accordingly, operational efficiency is well maintained. Also, the balance with a hydrophilic group is good, and the stability of the emulsion is well maintained.

Hydrocarbon groups for $R^{8e}$ are preferred to be saturated hydrocarbon groups such as those having straight-chain or cyclic structures. Specific examples are decyl groups, undecyl groups, dodecyl groups, tridecyl groups, tetradecyl groups, pentadecyl groups, hexadecyl groups, heptadecyl groups, octadecyl groups, nonadecyl groups, icocyl groups, and the like.

Among them, especially preferred are dodecyl groups, which are appropriately lipophilic with other components of the oil agent composition, and are capable of emulsifying the oil agent composition efficiently.

In formula (5e), "te" is the average number of added moles of EO, and is 3 to 20, preferably 5 to 15, more preferably 5 to 10. When "te" is at least 3, the oil agent composition exhibits affinity with water, making it easier to achieve a sufficiently stable emulsion. On the other hand, if "te" is 20 or less, the viscosity will not be excessively high. Accordingly, when such a surfactant is used in an oil agent composition, it is easier to divide oil-treated precursor-fiber bundles.

Here, $R^{8e}$ is an element related to lipophilicity, and "te" is an element related to hydrophilicity. Therefore, the value of "te" is determined so as to make an appropriate combination with $R^{8e}$.

Commercially available products may be used for a nonionic surfactant. For example, nonionic surfactants represented by formula (4e) above include "Newpol PE-128" and "Newpol PE-68" made by Sanyo Chemical Industries Ltd., "Pluronic PE6800" made by BASF Japan, "Adeka Pluronic L-44" and "Adeka Pluronic P-75" made by Adeka Corporation; as nonionic surfactants represented by formula (5e) above, "Emulgen 105" and "Emulgen 109P" made by Kao Corporation, "Nikkol BL-9EX" and "Nikkol BS-20" made by Nikko Chemicals Co., Ltd., "Nikkol BL-9EX" made by Wako Pure Chemical Industries Ltd., "Emalex 707" made by Nihon Emulsion Co., Ltd., and so on.

(Antioxidant)

The oil agent composition may further contain an antioxidant.

The content of an antioxidant is preferred to be 1 to 5 mass %, preferably 1 to 3 mass %, relative to the entire mass of the oil agent composition. When the content of an antioxidant is at least 1 mass %, sufficient antioxidation effects are obtained. When the content of an antioxidant is 5 mass % or less, it is easier to homogeneously disperse the antioxidant in the oil agent composition.

Various known substances may be used for antioxidants, but phenol-based or sulfur-based antioxidants are preferred.

Examples of phenol-based antioxidants are 2,6-di-t-butyl-p-cresol, 4,4'-butylidene-bis(6-t-butyl-3-methylphenol), 2,2'-methylenebis(4-methyl-6-t-butylphenol), 2,2'-methylenebis(4-ethyl-6-t-butylphenol), 2,6-di-t-butyl-4-ethylphenol, 1,1,3-tris(2-methyl-4-hydroxy-5-t-butylphenyl)butane, n-octadecyl-3-(3,5-di-t-butyl-4-hydroxyphenyl)propionate, tetrakis[methylene-3-(3,5-di-t-butyl-4-hydroxyphenyl)propionate] methane, triethylene glycol bis[3-(3-t-butyl-4-hydroxy-5-methylphenyl)propionate], tris(3,5-di-t-butyl-4-hydroxybenzyl)isocyanurate, and the like.

Specific examples of sulfur-based antioxidants are dilauryl thiodipropionate, distearyl thiodipropionate, dimyristyl thiodipropionate, ditridecyl thiodipropionate, and the like. Those antioxidants may be used alone or in combination thereof.

(Antistatic Agent)

The oil agent composition may further contain an antistatic agent.

The content of an antistatic agent relative to the entire mass of an oil agent composition is preferred to be 5 to 15 mass %. When the content of antistatic agent is in such a range, antistatic effects are achieved without decreasing the effects of the present invention.

Known substances may be used for an antistatic agent. Antistatic agents are roughly sorted into ionic types and nonionic types. Ionic antistatic agents include anionic, cationic and amphoteric types. Nonionic types include polyethylene glycol-based and polyhydric alcohol-based antistatic agents. To prevent static, ionic types are preferred; especially preferred are aliphatic sulfonates, higher alcohol sulfates, ethylene oxide adducts of higher alcohol sulfates, higher alcohol phosphates, ethylene oxide adducts of higher alcohol phosphates, quaternary ammonium salt-type cationic surfactants, betaine-type amphoteric surfactants, ethylene oxide adducts of higher alcohol polyethylene glycol fatty acid esters, polyhydric alcohol fatty acid esters, and the like. Those antistatic agents may be used alone or in combination thereof.

(Other Components)

In addition, depending on the usage environment or facility for applying the oil agent composition to precursor-fiber bundles, the oil agent composition may further contain other additives such as defoaming agents, preservatives, antimicrobial agents and osmotic agents so as to improve the stability of the oil agent composition and of the manufacturing process, and to enhance the adhesiveness of the oil agent composition.

Moreover, the oil agent composition may contain a known oil agent (for example, aliphatic esters and amino-modified silicones (excluding the aforementioned amino-modified silicone (H)) other than the aforementioned oil agent related to the present invention within a range that does not decrease the effects of the present invention.

Relative to the entire mass of oil agent contained in an oil agent composition, the content of the aforementioned oil agent of the present invention is preferred to be at least 60 mass %, more preferably at least 80 mass %, even more preferably at least 90 mass %. Substantially 100 mass % is especially preferred.

The aforementioned oil agent and oil agent composition according to the embodiments of the present invention contain hydroxybenzoate (A), amino-modified silicone (H) and organic compound (X) as their essential components, thereby effectively preventing fusion among single fibers during the heating process while maintaining bundling properties during the stabilization process. In addition, since the formation of silicon compounds and scattering of silicone components and non-silicone components (ester components or the like) are suppressed, operational efficiency and processability of fibers are significantly improved, and industrial productivity is thereby maintained. As a result, efficient operations are consistently conducted to produce carbon-fiber bundles with excellent mechanical properties.

As described, the oil agent and oil agent composition according to the embodiments of the present invention are capable of solving problems associated with conventional oil agent compositions mainly contain silicone as well as problems associated with oil agent compositions containing a reduced amount of silicone or containing only ester components.

Moreover, even when the emulsifier content is low, it is easier to emulsify the oil agent and oil agent composition according to the embodiments of the present invention.

[Oil-Treatment-Liquid for Carbon-Fiber-Precursor Acrylic Fiber]

The oil agent composition related to the present invention is preferred to be applied to a precursor-fiber bundle after dispersing the oil agent composition in water to form an oil-treatment-liquid.

[Carbon-Fiber-Precursor Acrylic Fiber Bundle]

The carbon-fiber-precursor acrylic fiber bundle according to an embodiment of the present invention is formed by applying the oil agent related to the present invention to a precursor-fiber bundle comprising acrylic fibers through oil treatment.

<Method for Producing Carbon-Fiber-Precursor Acrylic Fiber Bundle>

To obtain a carbon-fiber-precursor acrylic fiber bundle, it is preferred to apply the aforementioned oil agent or oil agent composition (oil treatment) to, for example, a water-swollen precursor-fiber bundle, and to conduct a drying and densification process on the oil-treated precursor-fiber bundle.

The following describes examples of a method for manufacturing a carbon-fiber-precursor acrylic fiber bundle by conducting oil treatment on a precursor-fiber bundle using an oil-treatment-liquid obtained by dispersing in water the oil agent composition related to the present invention.

(Precursor-Fiber Bundle)

An acrylic fiber bundle obtained by a known spinning method is used for a pre-oil-treated precursor-fiber bundle in an embodiment of the present invention. Specific examples are acrylic fiber bundles obtained by spinning acrylonitrile-based polymers.

Acrylonitrile-based polymers are obtained by polymerizing acrylonitrile as the main monomer. Acrylonitrile-based polymers may be a homopolymer made only of acrylonitrile, or an acrylonitrile-based copolymer containing acrylonitrile as the main component and other additional monomers.

The content of the acrylonitrile unit in an acrylonitrile-based copolymer is preferred to be 96.0 to 98.5 mass % when considering fusion preventability during the calcination process, heat resistance of the copolymer, stability of the spinning dope, and quality of the subsequent carbon fibers. The amount of the acrylonitrile unit is preferred to be 96.0 mass % or greater, since thermal fusion among fibers is prevented during the calcination process for converting acrylic fibers to carbon fibers, and excellent quality and properties of carbon fibers are maintained. In addition, the heat resistance of the copolymer itself does not decrease, and adhesion among single fibers is prevented during, for example, drying fibers or drawing fibers using hot rollers or pressurized steam in the spinning process. Moreover, the acrylonitrile unit is preferred to be contained at 98.5 mass % or lower, since its solubility into a solvent does not decrease, and the stability of a spinning dope is maintained. Also, agglomeration of the gelled copolymer is less likely to occur, and stable production of precursor fibers is achieved.

Monomers other than acrylonitrile for the copolymer may be selected from vinyl-based monomers copolymerizable with acrylonitrile; preferred examples are acrylic acid, methacrylic acid and itaconic acid, or their alkali metal salts or ammonium salts, acrylamides or the like which are capable of facilitating stabilization (fire proofing).

As the vinyl-based monomers copolymerizable with acrylonitrile, carboxyl-group-containing vinyl-based monomers, such as acrylic acid, methacrylic acid and itaconic acid, are more preferred. The content of carboxyl-group-containing vinyl-based monomer units is preferred to be 0.5 to 2.0 mass % of the acrylonitrile-based copolymer.

Those vinyl-based monomers may be used alone or in combination thereof.

For a spinning process, the acrylonitrile-based polymer is dissolved into a solvent to prepare a spinning dope. The solvent may be selected from known solvents such as follows: organic solvents such as dimethylacetamide, dimethylsulfoxide and dimethylformamide, and water-solutions of inorganic compounds such as zinc chloride, sodium thiocyanate and the like. Among those, from the viewpoint of enhancing productivity, dimethylacetamide, dimethylsulfoxide and dimethylformamide are preferred because of their fast coagulation capability. Dimethylacetamide is more preferred.

In addition, to obtain densely coagulated yarn, the spinning dope is preferred to have at least a certain polymer concentration. Specifically, the polymer concentration of the spinning dope is preferred to be at least 17 mass %, more preferably at least 19 mass %.

Since a spinning dope needs to have appropriate viscosity and liquidity, the polymer concentration is preferred to be not more than 25 mass %.

As for the spinning method, any known methods may be appropriately employed, for example, a wet spinning method in which the above spinning dope is directly spun into a coagulation bath, a dry spinning method in which the spinning dope is coagulated in air, and a dry-wet spinning method in which the spinning dope is spun once in air and then coagulated in a bath. For obtaining a carbon-fiber bundle that exhibits higher characteristics, a wet spinning method or a dry-wet spinning method is preferred.

Spinning and shaping by a wet spinning method or a dry-wet spinning method may be performed by spinning and shaping the above spinning dope into a coagulation bath through a nozzle having holes with a circular cross section. An aqueous solution containing the solvent used for the above spinning dope is preferably used as the coagulation bath since it is easier to recycle the solvent.

When an aqueous solution containing a solvent is used for the coagulation bath, the solvent concentration in the aqueous solution is preferably 50 to 85 mass % and the temperature of the coagulation bath is preferably 10 to 60° C. Using an aqueous solution prepared as above, a dense structure where hardly any void is observed is obtained enabling a higher-performance carbon-fiber bundle, drawability is ensured, excellent productivity is achieved, and so on.

After being produced by dissolving a polymer or a copolymer in a solvent to form a spinning dope, which is then discharged into a coagulation bath, coagulated fibers undergo a drawing process in a coagulation bath or in a drawing bath. Alternatively, it is an option to draw the coagulated fibers in air before drawing them in a drawing bath. By washing with water before, after or simultaneously with drawing, a water-swollen precursor-fiber bundle is obtained.

Considering the properties of resultant carbon-fiber bundles, the drawing in a bath is preferred to be performed in a water bath of 50 to 98° C. in one stage or multiple stages, and the coagulated-yam is preferably drawn in air and in a bath to have a total draw ratio of 2 to 10 times.

(Oil Treatment)

To apply an oil agent to a precursor-fiber bundle, it is preferred to apply an oil treatment liquid prepared by dispersing in water an oil agent composition containing the oil agent related to the present invention (hereinafter, simply referred to as an "oil-treatment-liquid") to carbon-fiber-precursor acrylic fibers. The average particle diameter of the emulsified particles just dispersed is preferred to be 0.01-0.3 m.

If the average particle diameter of the emulsified particles is in the above range, the oil agent is applied more homogeneously to a precursor-fiber bundle.

The average particle diameter of the emulsified particles in an oil-treatment-liquid can be measured using a laser diffraction/scattering particle-size distribution analyzer (LA-910, made by Horiba Ltd.)

An oil-treatment-liquid is prepared as follows, for example.

The aforementioned oil agent and a nonionic surfactant or the like are mixed to make an oil agent composition, to which water is added while stirring. Accordingly, an emulsion (aqueous emulsion) in which the oil agent composition is dispersed in water is obtained.

If an antioxidant is added, it is preferred to be dissolved in advance in the oil agent.

Each component in water is mixed or dispersed by using a propeller agitator, homo mixer, homogenizer or the like. To prepare an aqueous emulsion using a highly viscous oil agent composition, it is preferred to use a super-pressure homogenizer capable of pressurizing at 150 MPa or higher.

The concentration of the oil agent composition in an aqueous emulsion is preferred to be 2 to 40 mass %, more preferably 10 to 30 mass %, especially preferably 20 to 30 mass %. When the concentration of the oil agent composition is 2 mass % or higher, it is easier to give a necessary amount of the oil agent to a water-swollen precursor-fiber bundle. When the concentration is 40 mass % or lower, the aqueous emulsion exhibits excellent stability and dis-emulsification seldom occurs.

As for an oil-treatment-liquid, the obtained aqueous emulsion may be used as is, but the aqueous emulsion is preferred to be further diluted to a certain concentration level and used as an oil-treatment-liquid.

Here, a "certain concentration level" is prepared according to the condition of a precursor-fiber bundle during oil treatment.

To apply the oil agent to a precursor-fiber bundle, the oil-treatment-liquid is adhered to a water-swollen precursor-fiber bundle that has been drawn in a bath.

When a bundle is washed after the drawing process in a bath, it is also an option for the oil-treatment-liquid to be adhered to the water-swollen fiber bundle after the drawing process in the bath and the washing process.

To adhere an oil-treatment-liquid to a water-swollen precursor-fiber bundle, known methods such as follows may be used: a roller application method in which the lower portion of a roller is immersed in an oil-treatment-liquid and a precursor-fiber bundle is brought into contact with the upper portion of the roller; a guide application method in which a predetermined amount of an oil-treatment-liquid is discharged from a guide surface using a pump and a precursor-fiber bundle is brought into contact with the guide surface; a spraying method in which a predetermined amount of an oil-treatment-liquid is jet-sprayed from a nozzle onto a precursor-fiber bundle; and a dipping method in which a precursor-fiber bundle is dipped in an oil-treatment-liquid and squeezed using a roller or the like so that excess oil-treatment-liquid is removed.

Among those, a dipping method is preferred considering homogeneous application, since an oil-treatment-liquid is infiltrated well into a precursor-fiber bundle and an excess amount is removed. For even better homogeneous application, it is effective to conduct the oil treatment multiple times so as to apply the oil-treatment-liquid repeatedly.

(Drying Densification Process)

Next, drying densification is conducted on the oil-treated precursor-fiber bundle.

It is necessary to conduct a drying densification process at a temperature exceeding the glass transition temperature of the precursor-fiber bundle; however, the glass transition temperature may vary depending on whether the fibers are wet or dried. It is preferable, for example, to perform a drying densification process by using a heating roller kept at a temperature of 100 to 200° C. In such a method, one or more heating rollers may be used.

(Secondary Drawing Process)

After the drying densification process, the precursor-fiber bundle is preferred to undergo a pressurized steam drawing process using a hot roller. The density and orientation of the obtained carbon-fiber-precursor acrylic fiber bundle are further enhanced by such pressurized steam drawing process.

Here, pressurized steam drawing is a method for drawing fibers in a pressurized steam atmosphere. Since a higher drawing rate is achieved from pressurized steam drawing, stable spinning is conducted at a higher speed while the resultant fiber density and orientation are improved.

In a pressurized steam drawing process, the temperature of the hot roller positioned directly before the pressurized steam drawing apparatus is preferred to be set at 120 to 190° C., and the fluctuation of steam pressure during pressurized steam drawing is preferred to be controlled to be no greater than 0.5%. By controlling the temperature of the hot roller and the fluctuation rate of steam pressure, variations in draw rates of fiber bundles and the resultant tow fineness are suppressed. If the temperature of the hot roller is lower than 120° C., the temperature of a precursor-fiber bundle does not rise enough and stretchability tends to decrease accordingly.

The steam pressure in pressurized steam drawing is preferred to be 200 kPaG or higher (gauge pressure, the same applies hereinafter) so that drawing by a hot roller is controlled and the effects of pressurized steam drawing are obtained clearly. The steam pressure is preferred to be adjusted properly according to the processing duration. Since the amount of steam leakage may increase under high pressure, approximately 600 kPaG or lower is preferred for industrial production.

A carbon-fiber-precursor acrylic fiber bundle obtained after drying densification and a secondary drawing by a hot roller is cooled to room temperature by passing it over a room-temperature roller and then is wound on a bobbin by using a winder or is housed in a container.

The oil agent composition is preferred to be adhered as much as 0.3 to 2.0 mass %, more preferably 0.6 to 1.5 mass %, relative to the dry fiber mass of the carbon-fiber-precursor acrylic fiber bundle obtained as above. To sufficiently obtain the effects from the original characteristics of oil agent composition, the amount of adhered oil agent composition is preferred to be at least 0.3 mass %. To suppress polymerization of the extra adhered oil agent composition during the calcination process and to suppress agglutination among single fibers, the adhesion amount is preferred to be 2.0 mass % or lower.

Here, "dry fiber mass" means that of a precursor-fiber bundle after the drying densification process.

Considering mechanical properties, cyclohexanedicarboxylate (C) is preferred to be adhered as much as 0.10 to 0.40 mass %, more preferably 0.20 to 0.30 mass %, of the dry fiber mass of a carbon-fiber-precursor acrylic fiber bundle. When the adhered amount of cyclohexanedicarboxylate (C) is in the above range, the thermal stability of cyclohexanedicarboxylate (C) is effectively utilized, and the processability of the precursor-fiber bundle and the properties of the obtained carbon fibers are excellent.

Considering mechanical properties, hydroxybenzoate (A) is preferred to be adhered as much as 0.10 to 0.40 mass %, more preferably at 0.20 to 0.30 mass %, of the dry fiber mass of a carbon-fiber-precursor acrylic fiber bundle. When the adhered amount of hydroxybenzoate (A) is in the above range, it is compatible with other components, and thus the oil agent is applied homogeneously on the surface of a fiber bundle. Accordingly, fusion prevention effects are expected to be high during the stabilization process, thus enhancing the mechanical properties of the carbon fibers.

To obtain a carbon fiber with excellent mechanical properties, the mass ratio of hydroxybenzoate (A) to the mass of cyclohexanedicarboxylate (C) [(C)/(A)] is preferred to be 1/5 to 5/1, more preferably 1/4 to 4/1, even more preferably 1/3 to 3/1.

In addition, the amount of amino-modified silicone (H) adhered to the carbon-fiber-precursor acrylic fiber bundle is preferred to be 0.05 to 0.20 mass %, more preferably 0.10 to 0.20 mass % when mechanical properties are considered. The adhered amount of amino-modified silicone (H) in the above range prevents process failure caused by inorganic silicon compounds during calcination, and effectively provides bundling properties to the fiber bundle. Accordingly, excellent mechanical properties are achieved.

Moreover, when the adhered amount of amino-modified silicone (H) is set at more than 0.20 and less than or equal to 0.60 mass %, the content of at least either of high-cost cyclohexanedicarboxylate (C) and hydroxybenzoate (A) may be reduced to a degree that does not decrease the effects of the oil agent. As a result, while aiming at a reduction in cost of raw materials for oil agent compositions, excellent mechanical properties are achieved without experiencing process failure caused by inorganic silicon compounds during the calcination process.

To achieve carbon fibers with excellent mechanical properties, the ratio of the total mass of adhered cyclohexanedicarboxylate (C) and hydroxybenzoate (A) to the mass of adhered amino-modified silicone (H) [(H)/[(A)+(C)]] is preferred to be 1/16 to 3/5, more preferably 1/15 to 1/2, even more preferably 1/15 to 2/5.

Moreover, when the mass ratio [(H)/[(A)+(C)]] is set at more than 3/5 and less than or equal to 3/1, the content of at least either of high-cost cyclohexanedicarboxylate (C) and hydroxybenzoate (A) may be reduced to a degree that does not decrease the effects of the oil agent. As a result, while aiming at a reduction in cost of raw materials for oil agent compositions, excellent mechanical properties are achieved without experiencing process failure caused by inorganic silicon compounds during the calcination process.

Furthermore, when a nonionic surfactant is added to the oil agent composition, the nonionic surfactant is preferred to be adhered as much as 0.20 to 0.40 mass % of the dry fiber mass of a carbon-fiber-precursor acrylic fiber bundle. If the amount of adhered nonionic surfactant is in the above range, it is easier to prepare an aqueous emulsion of the oil agent composition, and foaming in a oil dipping bath caused by excess surfactant is suppressed while a decrease in the bundling properties of fiber bundles is prevented.

The amount of adhered oil agent composition is obtained as follows.

Based on a Soxhlet extraction method using methyl ethyl ketone, the methyl ethyl ketone heated at 90° C. to be vaporized is refluxed and brought into contact with a carbon-fiber-precursor acrylic fiber bundle for 8 hours so as to extract the oil agent composition. Then, pre-extraction mass ($W_1$) of the carbon-fiber-precursor acrylic fiber bundle dried at 105° C. for 2 hours, and post-extraction mass ($W_2$) of the carbon-fiber-precursor acrylic fiber bundle dried at 105° C. for 2 hours are each measured to obtain the amount of adhered oil agent composition by the following formula (i).

$$\text{adhesion amount of oil agent composition [mass \%]} = (W_1 - W_2)/W_1 \times 100 \quad \text{(i)}$$

The amount of each component contained in the oil agent composition adhered to the carbon-fiber-precursor acrylic fiber bundle is calculated from the amount of adhered oil agent composition and the component makeup of the oil agent composition.

The component makeup of the oil agent composition adhered to a carbon-fiber-precursor acrylic fiber bundle is preferred to be the same as that of the prepared oil agent composition from the viewpoint of balancing the supply and consumption amounts of the oil agent composition in the oil processing tank.

The number of filaments of a carbon-fiber-precursor acrylic fiber bundle according to an embodiment of the present invention is preferred to be 1000 to 300000, more preferably 3000 to 200000, even more preferably 12000 to 100000. When the number of filaments is 1000 or more, high production efficiency is achieved, and when the number of filaments is 300000 or fewer, a homogeneous carbon-fiber-precursor acrylic fiber bundle is expected to be obtained.

The greater the single fiber fineness in a carbon-fiber-precursor acrylic fiber bundle according to an embodiment of the present invention, the greater the fiber diameter is in the obtained carbon-fiber bundle, and buckling distortion under compression stress is suppressed when the carbon-fiber bundle is used as reinforcing fibers of a composite material. From the viewpoint of improving compression strength, the greater the single fiber fineness, the better it is. However, if the single fiber fineness is greater, uneven results of calcination of the carbon-fiber-precursor acrylic fiber bundle may be brought about in a later-described stabilization process. Thus, it is not preferable from the viewpoint of achieving homogeneous fibers. Considering those features, the single fiber fineness of a carbon-fiber-precursor acrylic fiber bundle is preferred to be 0.6 to 3 dTex, more preferably 0.7 to 2.5 dTex, even more preferably 0.8 to 2.0 dTex.

To the carbon-fiber-precursor acrylic fiber bundle according to an embodiment of the present invention as described so far, an oil agent having essential components such as the aforementioned hydroxybenzoate (A), amino-modified silicone (H) and organic compound (X) is adhered. Thus, fusion among single fibers is effectively prevented during the calcination process, while the bundling properties are maintained during the stabilization process. In addition, formation of silicon compounds and scattering of silicone components and non-silicone components (such as ester components) are suppressed, thereby achieving significant improvements in operational efficiency and processability while maintaining industrial productivity. Accordingly, stable continuous operations are conducted to produce carbon-fiber bundles with excellent mechanical properties at high yield. Moreover, in a production process of carbon-fiber-precursor acrylic fiber bundles, it is easier to emulsify the oil agent related to the present invention even with a low emulsifier content.

As described, using carbon-fiber-precursor acrylic fiber bundles related to the present invention solves conventional problems such as those caused by silicone-based oil agents as well as those caused by oil agents containing a low silicone content or containing only ester components.

The carbon-fiber-precursor acrylic fiber bundle according to an embodiment of the present invention then undergoes calcination; stabilization and carbonization are conducted, while graphitization and surface treatment are conducted thereon if applicable, and the carbon-fiber-precursor acrylic fiber bundle ultimately becomes a carbon-fiber bundle.

In a stabilization process, the carbon-fiber-precursor acrylic fiber bundle is heated in an oxidizing atmosphere to be converted to a stabilized fiber bundle.

For stabilization, the fiber bundle under tension is heated at 200 to 300° C. in an oxidizing atmosphere until the density becomes 1.28 to 1.42 g/cm$^3$, preferably 1.29 to 1.40 g/cm$^3$. A density of at least 1.28 g/cm$^3$ prevents fusion among single fibers in the subsequent carbonization process, thus leading to a trouble-free operation during carbonization. A density of no greater than 1.42 g/cm$^3$ is preferable in terms of cost performance, since the stabilization duration will not be too extended. Known oxidizing atmosphere such as air, oxygen and nitrogen dioxide are employed, but air is preferable considering the cost.

As for an apparatus for conducting stabilization, it is not limited to any specific type. Known methods using a hot air convection oven, bringing fiber bundles into contact with a heated solid surface, and the like may be employed. In the case of using a stabilization oven (hot air convection oven), a carbon-fiber-precursor acrylic fiber bundle introduced into the stabilization oven is brought out of the oven and U-turned using a U-turn roll disposed outside the furnace so that the fiber bundle passes repeatedly through the oven. Alternatively, a fiber bundle may be brought into contact intermittently with heated solid surfaces.

The stabilized fiber bundle then proceeds to a carbonization process.

The stabilized fiber bundle is carbonized in an inert atmosphere to obtain a carbon-fiber bundle. Carbonization is performed in an inert atmosphere at an upper temperature of 1000° C. or higher. To form an inert atmosphere, any inert gases such as nitrogen, argon and helium may be used, but nitrogen is preferred considering cost performance.

At an initial stage of carbonization, namely, in a processing temperature range of 300 to 400° C., cleavage and crosslinking reactions occur in polyacrylonitrile copolymer, which is a component of the fiber. To enhance the mechanical properties of a carbon-fiber bundle ultimately obtained, the fiber temperature at this stage is preferred to be raised gradually at a rate of temperature rise no greater than 300° C./min.

In a processing temperature range of 400 to 900° C., thermal decomposition occurs in the polyacrylonitrile copolymer, and carbon structures are gradually formed. At such a stage, the fiber bundle is preferred to be processed while being drawn under tension because formation of highly oriented carbon structures is facilitated. Therefore, to control the temperature gradation and drawing rate (tensile force) up to 900° C., it is preferred to make a pre-carbonization process separate from the final carbonization process.

In a processing temperature range of 900° C. or higher, remaining nitrogen atoms are eliminated and the carbon structure will grow, thus contracting the fibers as a whole. To obtain excellent mechanical properties in the final carbon fibers, heat treatment in a high temperature range is preferred to be performed under tension.

If applicable, a graphitization process may be added to the carbon-fiber bundle obtained above. Graphitization further enhances the elastic modulus of the carbon-fiber bundle.

Graphitization is preferred to be conducted while the fibers are drawn at a rate of 3 to 15% in an inert atmosphere with an upper temperature set at 2000° C. or higher. A stretching rate of at least 3% forms a carbon-fiber bundle (graphitized fiber bundle) having a high elastic modulus and excellent mechanical properties. That is because, in order to obtain a carbon-fiber bundle having a predetermined elastic modulus, conditions with a lower stretching rate require a higher processing temperature. On the other hand, a stretching rate of 15% or lower forms high quality carbon fibers, because the effects of stretching to facilitate the growth of carbon structures are not so different between on the surface of and inside of the fibers, thus achieving homogeneous carbon-fiber bundles.

Surface treatment for final products is preferred to be performed on the carbon-fiber bundles after the abovementioned calcination process.

Surface treatment is not limited to any specific method, but electrolytic oxidation in an electrolyte solution is preferred. Surface improvement treatment through electrolytic oxidization is performed by generating oxygen on surfaces of carbon-fiber bundles to introduce oxygen-containing functional groups.

As for electrolytes, acids such as sulfuric acid, hydrochloric acid and nitric acid and their salts may be used.

Preferred conditions for electrolytic oxidation are an electrolyte temperature of room temperature or lower, an electrolyte concentration at 1 to 15 mass %, and amount of electricity at 100 coulomb/g or lower.

Carbon-fiber bundles obtained by calcinating carbon-fiber-precursor acrylic fiber bundles related to the present invention are of high quality with excellent mechanical properties, and are suitable to be used as reinforcing fibers in fiber-reinforced plastic composite material for various structural applications.

EXAMPLES

In the following, the present invention is described in further detail by referring to the examples. However, the present invention is not limited to those examples.

Components, measurement methods, and evaluation methods used for examples are shown below.

[Components]

<Hydroxybenzoate (A)>

A-1: ester compound of 4-hydroxybenzoic acid and oleyl alcohol (molar ratio of 1.0:1.0) (ester compound structured as in formula (1a) above, in which $R^{1a}$ is an octadecenyl group (oleyl group)).

Method for Synthesizing (A-1)

In a 1 L four neck flask, 207 grams (1.5 mol) of 4-hydroxybenzoic acid, 486 grams (1.8 mol) of oleyl alcohol and 0.69 grams (0.1 mass %) of tin octylate as the catalyst were measured, and esterification reactions were carried out at 200° C. for 6 hours and further at 220° C. for 5 hours while nitrogen was being introduced.

Then, excess alcohol was removed under conditions of 230° C. at reduced pressure of 666.61 Pa while steam was being blown in. Then, the mixture was cooled to approximately 70 to 80° C., to which 0.43 grams of 85 mass % phosphoric acid was added. The mixture was stirred for 30 minutes and then filtered to obtain A-1.

<Amino-modified Silicone (H)>

H-1: amino-modified silicone with a structure shown in formula (3e) above, in which "qe"≈80, "re"≈2, and "se"≈3, having a kinematic viscosity at 25° C. of 90 $mm^2/s$ and an amino equivalent weight of 2500 g/mol (product name: AMS-132, Gelest, Inc.)

H-9: amino-modified silicone with a structure shown in formula (3e) above, in which "qe"≈120, "re"≈1 and "se"≈3, having a kinematic viscosity at 25° C. of 150 $mm^2/s$ and an amino equivalent weight of 6000 g/mol.

H-4: amino-modified silicone structured to have primary and secondary amines on side chains, having a kinematic viscosity at 25° C. of 10000 $mm^2/s$ and an amino equivalent weight of 7000 g/mol (product name: TSF 4707, Momentive Performance Materials Japan LLC). This is not structured as in formula (3e) above.

<Organic Compound (X)>

(Cyclohexanedicarboxylate)

B-1: ester compound of 1,4-cyclohexanedicarboxylic acid and oleyl alcohol (molar ratio of 1.0:2.0) (ester compound structured as in formula (1b) above, in which $R^{1b}$ and $R^{2b}$ are each an oleyl group).

C-1: ester compound of 1,4-cyclohexanedicarboxylic acid, oleyl alcohol and 3-methyl-1,5-pentanediol (molar ratio of 2.0:2.0:1.0) (ester compound structured as in formula (2b) above, in which $R^{3b}$ and $R^{5b}$ are each an oleyl group, and $R^{4b}$ is $—CH_2CH_2CHCH_3CH_2CH_2—$).

C-2: ester compound of 1,4-cyclohexanedicarboxylic acid, oleyl alcohol and polyoxytetramethylene glycol (average molecular weight of 250) (molar ratio of 2.0:2.0:1.0) (ester compound structured as in formula (2b) above, in which $R^{3b}$ and $R^{5b}$ are each an oleyl group, and $R^{4b}$ is $—(CH_2CH_2CH_2CH_2O)_n—$, and "n" is 3.5).

(Method for Synthesizing B-1)

Into a 1 L four neck flask, 180 grams (0.9 mol) of 1,4-methylcyclohexanedicarboxylate (Kokura Synthetic Industries, Ltd.), 486 grams (1.8 mol) of oleyl alcohol (product name Rikacol 90B, made by New Japan Chemical Co., Ltd.) and 0.33 grams of dibutyltin oxide as the catalyst (made by Wako Pure Chemical Industries, Ltd.) were measured, and demethanol reactions were carried out at approximately 200 to 205° C. while nitrogen was being introduced. The amount of distilled methanol was 57 grams.

Then, the mixture was cooled to approximately 70 to 80° C., to which 0.34 grams of 85 mass % phosphoric acid (made by Wako Pure Chemical Industries) was added. The mixture was stirred for 30 minutes until the reaction system was confirmed to be clouded. Then, 1.1 grams of an adsorbent (product name: Kyoward 600S, made by Kyowa Chemical Industry, Ltd.) was added and the mixture was stirred for 30 minutes and filtered to obtain B-1.

B-1 was compatible with A-1, its residual mass rate (R1) was 70.3 mass % and it was liquid at 100° C.

(Method for Synthesizing C-1)

Into a 1 L four neck flask, 240 grams (1.2 mol) of 1,4-methylcyclohexanedicarboxylate (made by Kokura Synthetic Industries), 324 grams (1.2 mol) of oleyl alcohol (product name Rikacol 90B, made by New Japan Chemical), 70.8 grams (0.6 mol) of 3-methyl-1,5-pentanediol (made by Wako Pure Chemical Industries), and 0.32 grams of dibutyltin oxide as the catalyst (made by Wako Pure Chemical Industries) were measured, and demethanol reactions were carried out at approximately 200 to 205° C. by flowing nitrogen. The amount of distilled methanol was 76 grams.

Then, the mixture was cooled to approximately 70 to 80° C., to which 0.33 grams of 85 mass % phosphoric acid (made by Wako Pure Chemical Industries) was added. The mixture was stirred for 30 minutes until the reaction system was confirmed to be clouded. Then, 1.1 grams of an adsorbent (product name: Kyoward 600S, made by Kyowa Chemical Industry) was added and the mixture was stirred for 30 minutes and filtered to obtain C-1.

C-1 was compatible with A-1, its residual mass rate (R1) was 73.8 mass % and it was liquid at 100° C.

Method for Synthesizing C-2

Into a 1 L four neck flask, 240 grams (1.2 mol) of 1,4-methylcyclohexanedicarboxylate (made by Kokura Synthetic Industries), 324 grams (1.2 mol) of oleyl alcohol (product name Rikacol 90B, made by New Japan Chemical Industries), 150 grams (0.6 mol) of polyoxytetramethylene glycol (average molecular weight of 250, made by BASF Japan), and 0.36 grams of dibutyltin oxide as the catalyst (made by Wako Pure Chemical Industries) were measured, and demethanol reactions were carried out at approximately 200 to 205° C. by flowing nitrogen. The amount of distilled methanol was 76 grams.

Then, the mixture was cooled to approximately 70 to 80° C., to which 0.37 grams of 85 mass % phosphoric acid (made by Wako Pure Chemical Industries) was added. The mixture was stirred for 30 minutes until the reaction system was confirmed to be clouded. Then, 1.3 grams of an adsorbent (product name: Kyoward 600S, made by Kyowa Chemical Industry) was added and the mixture was stirred for 30 minutes and filtered to obtain C-2.

C-2 was compatible with A-1, its residual mass rate ($R^1$) was 79.3 mass % and it was liquid at 100° C.

Ester compounds B-1, C-1 and C-2 above were synthesized through demethanol reactions by a transesterification method. However, it is also an option to prepare them by esterification reactions of 1,4-cyclohexanedicarboxylic acid and an alcohol.

(Aromatic Ester Compound)

G-2: polyoxyethylene bisphenol A laurate (product name: Exceparl BP-DL, made by Kao Corporation).

G-2 was compatible with A-1, its residual mass rate ($R^1$) was 94.7 mass % and it was liquid at 100° C.

<Other Organic Compound>

E-1: ester compound of 1,4-cyclohexanedimethanol, oleic acid and dimer acid obtained by dimerizing oleic acid (molar ratio of 1.0:1.25:0.375) (ester compound structured as in (2c) below, in which $R^{3c}$ and $R^{5c}$ are each a C17 alkenyl group (heptadecenyl group), and $R^{4c}$ is a substituent obtained by detaching 1 hydrogen from the carbon atom in C34 alkenyl group (tetratriacontenyl group), and "mc" is 1).

[chem 18]

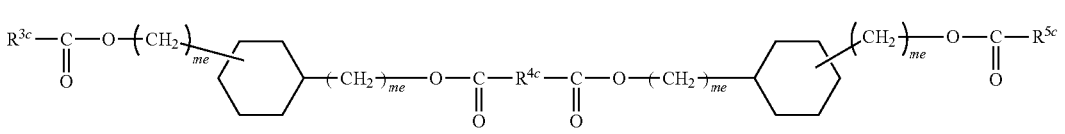

(2c)

(Method for Synthesizing E-1)

Into a 1 L four neck flask, 144 grams (1.0 mol) of 1,4-cyclohexanedimethanol (Wako Pure Chemical Industries), 350 grams (1.25 mol) of oleic acid (product name: Lunac OA, made by Kao Corporation), 213.8 grams (0.375 mol) of dimer acid (Sigma-Aldrich Japan K.K.), and 0.35 grams of dibutyltin oxide (made by Wako Pure Chemical Industries) as the catalyst were measured, and esterification reactions were carried out at approximately 220 to 230° C. by flowing nitrogen. The reactions were continued until the acid value of the reaction system became 10 mg KOH/g or lower.

Next, the mixture was cooled to approximately 70 to 80° C., to which 0.36 grams of 85 mass % phosphoric acid (made by Wako Pure Chemical Industries) was added. The mixture was stirred for 30 minutes until the reaction system was confirmed to be clouded. Then, 1.3 grams of an adsorbent (product name: Kyoward 600S, made by Kyowa Chemical Industry) was added and the mixture was stirred for 30 minutes and filtered to obtain E-1.

E-1 was compatible with A-1, its residual mass rate (R1) was 26.8 mass % and it was liquid at 100° C.

<Nonionic Surfactant>

K-1: PO/EO polyether block copolymer structured as in formula (4e) above, in which "xe"≈75, "ye"≈30, "ze"≈75, and $R^{6e}$ and $R^{7e}$ are each a hydrogen atom (product name: Newpol PE-68, made by Sanyo Chemical Industries, Ltd.).

K-2: polyoxyethylene lauryl ether structured as in formula (5e) above, in which "te"≈9, and $R^{8e}$ is a lauryl group (product name: Nikkol BL-9EX, made by Wako Pure Chemical Industries).

K-3: polyoxyethylene lauryl ether structured as in formula (5e) above, in which "te"≈7, and $R^{8e}$ is a lauryl group (product name: Emalex 707, made by Nihon Emulsion Co., Ltd.).

K-4: polyoxyethylene lauryl ether structured as in formula (5e) above, in which "te"≤9, and $R^{8e}$ is a dodecyl group (product name: Emulgen 109P, made by Kao Corporation).

K-5: PO/EO polyether block copolymer structured as shown in formula (4e) above, in which "xe"≈10, "ye"≈20, "ze"≈10, and $R^{6e}$ and $R^{7e}$ are each a hydrogen atom (product name: Adeka Pluronic L-44, made by Adeka Corporation).

K-6: PO/EO polyether block copolymer structured as in formula (4e) above, in which "xe"≈75, "ye"≈30, "ze"≈75, and $R^{6e}$ and $R^{7e}$ are each a hydrogen atom (product name: Pluronic PE 6800, made by BASF Japan).

K-7: nonaethylene glycol dodecyl ether structured as in formula (4e) above, in which "te"≈9, and $R^{8e}$ is a dodecyl group (product name: Nikkol BL-9EX, made by Nikko Chemicals).

K-10: polyoxyethylene tridecyl ether structured as in formula (5e) above, in which "te"≈5, and $R^{8e}$ is a tridecyl group (product name: Newcol 1305, made by Nippon Nyukazai Co., Ltd.).

<Antioxidant>

L-1: n-octadecyl-3-(3,5-di-t-butyl-4-hydroxyphenyl)propionate (product name: Tominox SS, made by API Corporation) L-2: tetrakis[methylene-3-(3,5-di-t-butyl-4-hydroxyphenyl)propionate]methane (product name: Tominox TT, made by API Corporation)

<Antistatic Agent>

M-2: lauryl trimethyl ammonium chloride (brand name: Quartamin 24P, made by Kao Corporation)

[Measurement/Evaluation]

<Evaluation: Ease of Handling for Emulsification>

For emulsification to prepare an oil-treatment-liquid, a high-pressure homogenizer (product name: Microfluidizer M-110EH, made by Microfluidics) was used, and 3 liters of oil-treatment-liquid was formed under conditions of 150 MPa. The ease of handling was evaluated based on the following evaluation criteria.

A: substantially no clogging occurred in the high-pressure homogenizer

B: clogging occurred once in the high-pressure homogenizer

C: clogging occurred two or more times in the high-pressure homogenizer

<Measuring Adhesion Amount of Oil Agent Composition>

After a carbon-fiber-precursor acrylic fiber bundle had been dried at 105° C. for 2 hours, based on a Soxhlet extraction method using methyl ethyl ketone, the methyl ethyl ketone heated at 90° C. to be vaporized was refluxed and brought into contact with the carbon-fiber-precursor acrylic fiber bundle for 8 hours so that the oil agent composition was extracted into the solvent. The amount of methyl ethyl ketone was determined at a sufficient level for extracting the oil agent composition adhered to the carbon-fiber-precursor acrylic fiber bundle.

Pre-extraction mass ($W_1$) of the carbon-fiber-precursor acrylic fiber bundle dried at 105° C. for 2 hours, and post-extraction mass ($W_2$) of the carbon-fiber-precursor acrylic fiber bundle dried at 105° C. for 2 hours were each measured to obtain the amount of adhered oil agent composition using the formula (i) below. The adhesion amount of oil agent is measured to confirm that the oil agent composition is adhered to a precursor-fiber bundle in a range appropriate to obtain the effect of applied oil agent composition.

$$\text{adhesion amount of oil agent composition [mass \%]} = (W_1 - W_2)/W_1 \times 100 \quad \text{(i)}$$

<Evaluation of Bundling Properties>

Visual inspection was conducted on carbon-fiber-precursor acrylic fiber bundles on a final roller, namely on the roller directly before the fiber bundles are wound on a bobbin, in the production process of carbon-fiber-precursor acrylic fiber bundles. The bundling properties were evaluated using the following evaluation criteria. Evaluation for bundling properties is for determining the quality of carbon-fiber-precursor acrylic fiber bundles from the viewpoints of the producibility of carbon-fiber-precursor acrylic fiber bundles and the ease of handling in the subsequent carbonization process.

A: bundled, the tow width is constant and adjacent fiber bundles are not in contact with each other.

B: bundled, but the tow width is not constant, or the tow width is wider.

C: not bundled, space is observed in a fiber bundle.

<Evaluation of Operational Efficiency>

Operational efficiency was evaluated by how often single fibers were wound around transport rollers and were removed while carbon-fiber-precursor acrylic fiber bundles were produced continuously for 24 hours. The evaluation criteria were as follows. Evaluated operational efficiency is used as an index of the production stability of carbon-fiber-precursor acrylic fiber bundles.

A: the number of times removed (times/24 hours) is one or lower.

B: the number of times removed (times/24 hours) is two to five.

C: the number of times removed (times/24 hours) is six or higher.

<Measuring Number of Fused Single Fibers>

A carbon-fiber bundle was cut into 3 mm length and dispersed in acetone, which was stirred for 10 minutes. Then, the total number of single fibers and the number of fused single fibers (fused number) were counted to determine the number of fused fibers per 60000 single fibers. The number of fused single fibers is used to evaluate the quality of carbon-fiber bundles.

<Measuring Strand Tensile Strength>

The production of carbon-fiber bundles was started, and while the production was stable and constant, carbon-fiber bundles were picked out for sampling. The strand tensile strength of the sampled carbon-fiber bundle was measured according to epoxy resin-impregnated strand testing specified in JIS-R-7608. The test was repeated 10 times and the average value was used for evaluation.

<Measuring Amount of Scattered Si>

The amount of scattered silicon compound derived from scattered silicone during the stabilization process is determined from the silicon (Si) content in a carbon-fiber-precursor acrylic fiber bundle and the Si content in the stabilized fiber bundle measured by an ICP optical emission spectrometry as the difference in the silicon contents. The amount of scattered Si was used as an evaluation index.

In particular, a carbon-fiber-precursor acrylic fiber bundle and a stabilized fiber bundle were each finely chopped with scissors to make samples, 50 mg each of the samples was weighed in a sealed crucible, and 0.25 grams each of powdered NaOH and KOH were added to the samples, which were then heated for thermal decomposition in a muffle furnace at 210° C. for 150 minutes. Then, the decomposed fibers were dissolved in distilled water to make 100 mL each of measurement samples. The Si content of each sample was obtained using ICP emission spectrometry, and the amount of scattered Si was calculated by the formula (ii) below. For the ICP optical emission spectrometer, "Iris Advantage AP" made by Thermo Electron Corporation was used.

$$\text{amount of scattered Si (mg/kg)} = [\text{Si content (mg) in carbon-fiber-precursor acrylic fiber bundle} - \text{Si content (mg) in stabilized fiber bundle}]/5.0\times 10^{-5}\ \text{(kg)} \quad \text{(ii)}$$

<Measuring Amount of Scattered Esters or the Like>

The amount of esters or the like derived from hydroxybenzoate (A), cyclohexanedicarboxylate, aromatic ester compound and other organic compounds that were scattered during the stabilization process was calculated from the sum of ester components or the like adhered to 1 kg of precursor-fiber bundle and the residual mass rate (R1) of the mixture of ester components or the like.

$$\text{amount of scattered esters or the like (mg/kg)} = \text{sum of ester components or the like adhered to 1 kg of precursor-fiber bundle (mg/kg)} \times (1 - \text{residual mass rate } (R1) \text{ of the mixture of ester components or the like}/100)$$

Example 1

<Preparing Oil Agent Composition and Oil-Treatment-Liquid>

Hydroxybenzoate (A-1), amino-modified silicone (H-9), cyclohexanedicarboxylate (C-2) and antistatic agent (M-2) were mixed, to which nonionic surfactant (K-4) was further added and stirred well to prepare an oil agent composition.

While the oil agent composition was being stirred, deionized water was added to set the concentration of the oil agent composition at 30 mass %. Then, the mixture was emulsified by a homo-mixer. The average particle size of the micelles at that time was measured by a laser diffraction/scattering particle-size distribution analyzer (product name: LA-910, made by Horiba Ltd.) and found to be approximately 3.0 μm.

Next, using a high-pressure homogenizer, the oil agent composition was dispersed until the average particle size of the micelles became 0.2 μm, and an aqueous emulsion of the oil agent composition was obtained. The aqueous emulsion was further diluted with deionized water to prepare an oil-treatment-liquid with an oil agent composition concentration of 1.3 mass %.

Types and amounts (parts by mass) of components in the oil agent composition are shown in Table 1.

In addition, ease of handling during the emulsification process was evaluated. The results are shown in Table 1.

<Producing Carbon-Fiber-Precursor Acrylic Fiber Bundle>

A precursor-fiber bundle to apply the oil agent was prepared as follows. An acrylonitrile-based copolymer (composition ratio: acrylonitrile/acrylamide/methacrylic acid=96.5/2.7/0.8 (mass ratio)) was dispersed in dimethylacetamide at a rate of 21 mass % and dissolved by heating to prepare a spinning dope. In a 38° C. coagulation bath filled with a dimethylacetamide solution with a concentration of 67 mass %, the spinning dope was discharged from a spinning nozzle having 60000 holes with a hole size (diameter) of 45 μm to make coagulated fibers. The coagulated fibers were washed in a water bath to remove the solvent and were drawn to be three times as long to obtain a water-swollen precursor-fiber bundle.

The water-swollen precursor-fiber bundle was introduced into the oil-treatment bath filled with the oil-treatment-liquid prepared as above to apply the oil agent.

The precursor-fiber bundle with the applied oil agent underwent a drying densification process using a roller with a surface temperature of 150° C., and then steam drawing was performed under 0.3 MPaG pressure to make the bundle five times as long. Accordingly, a carbon-fiber-precursor acrylic fiber bundle was obtained. The number of filaments in the carbon-fiber-precursor acrylic fiber bundle was 60000, and the single fiber fineness was 1.0 dTex.

Bundling properties and operational efficiency during the production process were evaluated, and the amount of oil agent composition on the carbon-fiber-precursor acrylic fiber bundle was measured. The results are shown in Table 1.

<Producing Carbon-Fiber Bundle>

The carbon-fiber-precursor acrylic fiber bundle was set to pass for 40 minutes through a stabilization oven heated to have a temperature gradient of 220 to 260° C. so as to produce a stabilized fiber bundle.

Next, the stabilized fiber bundle was set to pass for 3 minutes through a carbonization furnace having a nitrogen atmosphere and heated to have a temperature gradient of 400 to 1400° C. so as to calcinate the fiber bundle. Accordingly, a carbon-fiber bundle was obtained.

The amount of Si and the amount of esters and the like scattered during the stabilization process were measured. Also, the number of fused single fibers in the carbon-fiber bundle and the strand tensile strength were measured. The results are shown in Table 1.

Examples 2-22, Reference Example 23

Oil agent compositions and oil-treatment-liquids were prepared the same as in Example 1 except that the types and amounts of components in each oil agent composition were changed as shown in Tables 1, 2 and 3. Then, carbon-fiber-precursor acrylic fiber bundles and carbon-fiber bundles were produced respectively. Measurements and evaluations were conducted in each example. The results are shown in Tables 1, 2 and 3.

Comparative Examples 1-16

Oil agent compositions and oil-treatment-liquids were prepared the same as in Example 1 except that the types and amounts of components in each oil agent composition were changed as shown in Tables 4 and 5. Then, carbon-fiber-precursor acrylic fiber bundles and carbon-fiber bundles were produced respectively. Measurements and evaluations were conducted in each example. The results are shown in Tables 4 and 5.

TABLE 1

| | | | | | | 1 | 2 | 3 | 4 | 5 | 6 | 7 |
|---|---|---|---|---|---|---|---|---|---|---|---|---|
| Components [parts by mass] | Oil agent composition | Oil agent | A | Ester compound | A-1 | 8.3 | 12 | 20 | 5 | 15 | 20 | 7 |
| | | | X | | B-1 | | | | | | 7 | |
| | | | | | C-1 | | | | | | | |
| | | | | | C-2 | 8.3 | 12 | 10 | 25 | 15 | | |
| | | | | | G-2 | | | | | | | 20 |
| | | | Other | | E-1 | | | | | | | |
| | | | H | Amino-modified silicone | H-1 | | | | | | 30 | 30 |
| | | | | | H-9 | 50 | 40 | 50 | 50 | 35 | | |
| | | | | | H-4 | | | | | | | |
| | | H/(A + H + X + other) | | | | 0.75 | 0.63 | 0.63 | 0.63 | 0.54 | 0.53 | 0.53 |
| | | A/(A + X + other) | | | | 0.50 | 0.50 | 0.67 | 0.17 | 0.50 | 0.74 | 0.26 |
| | | Nonionic surfactant | | | K-1 | | | | | | 15 | 15 |
| | | | | | K-2 | | | | | | | |
| | | | | | K-3 | | | | | | 15 | 15 |
| | | | | | K-4 | 27.8 | 28 | 30 | 30 | 30 | | |
| | | | | | K-5 | | | | | | | |
| | | | | | K-6 | | | | | | | |
| | | | | | K-7 | | | | | | | |
| | | | | | K-10 | | | | | | | |
| | | Antioxidant | | | L-1 | | | | | | | |
| | | | | | L-2 | | | | | | | |
| | | Antistatic agent | | | M-2 | 5.6 | 8 | 5 | 5 | 5 | 5 | 5 |
| A + H + X + other [parts by mass] | | | | | | 66.6 | 64 | 80 | 80 | 65 | 57 | 57 |
| Nonionic surfactant per 100 parts by mass of oil agent [parts by mass] | | | | | | 41.7 | 43.8 | 37.5 | 37.5 | 46.2 | 52.6 | 52.6 |
| Antioxidant per 100 parts by mass of oil agent [parts by mass] | | | | | | 0.0 | 0.0 | 0.0 | 0.0 | 0.0 | 0.0 | 0.0 |
| Antistatic agent per 100 parts by mass of oil agent [parts by mass] | | | | | | 8.4 | 12.5 | 6.3 | 6.3 | 7.7 | 8.8 | 8.8 |
| Adhesion amount of oil agent composition [mass %] | | | | | | 1.1 | 1.2 | 0.9 | 0.9 | 1.1 | 1.1 | 0.9 |
| Evaluation | Ease of handling during emulsification process | | | | | A | A | A | A | A | A | A |
| | Bundling properties | | | | | A | A | A | A | A | A | A |
| | Operational efficiency | | | | | A | A | A | A | A | A | A |
| | Number of fused single fibers [per bundle] | | | | | 0 | 1 | 0 | 5 | 3 | 0 | 5 |
| | Strand tensile strength [GPa] | | | | | 5.2 | 5.2 | 5.3 | 5.1 | 5.1 | 5.3 | 5.1 |
| | Amount of scattered Si [mg/kg] | | | | | 540 | 400 | 540 | 560 | 380 | 400 | 390 |
| | Amount of scattered ester or the like [mg/kg] | | | | | 610 | 910 | 950 | 1120 | 1150 | 1080 | 430 |

TABLE 2

| | | | | | | Examples | | | | | |
|---|---|---|---|---|---|---|---|---|---|---|---|
| | | | | | | 8 | 9 | 10 | 11 | 12 | 13 |
| Components [parts by mass] | Oil agent composition | Oil agent | A | Ester compound | A-1 | 20 | 10 | 30 | 25 | 5 | 10 |
| | | | X | | B-1 | | 40 | | | 5 | 5 |
| | | | | | C-1 | | | | | | |
| | | | | | C-2 | 20 | | 15 | 5 | | |
| | | | | | G-2 | | | | | | |
| | | | Other | | E-1 | | | | | | |
| | | | H | Amino-modified silicone | H-1 | 35 | 45 | 35 | | | 70 |
| | | | | | H-9 | | | | 50 | 60 | |
| | | | | | H-4 | | | | | | |
| | | H/(A + H + X + other) | | | | 0.47 | 0.47 | 0.44 | 0.63 | 0.86 | 0.82 |
| | | A/(A + X + other) | | | | 0.50 | 0.20 | 0.67 | 0.83 | 0.50 | 0.67 |
| | | Nonionic surfactant | | | K-1 | | 15 | 15 | | | |
| | | | | | K-2 | | | | | | |
| | | | | | K-3 | | 15 | 15 | | | |
| | | | | | K-4 | 40 | | | 30 | 25 | 25 |
| | | | | | K-5 | | | | | | |
| | | | | | K-6 | | | | | | |
| | | | | | K-7 | | | | | | |
| | | | | | K-10 | | | | | | |
| | | Antioxidant | | | L-1 | | | | | | |
| | | | | | L-2 | | | | | | |
| | | Antistatic agent | | | M-2 | 5 | 5 | 5 | 5 | 5 | 5 |
| A + H + X + other [parts by mass] | | | | | | 75 | 95 | 80 | 80 | 70 | 85 |
| Nonionic surfactant per 100 parts by mass of oil agent [parts by mass] | | | | | | 53.3 | 31.6 | 37.5 | 37.5 | 35.7 | 29.4 |
| Antioxidant per 100 parts by mass of oil agent [parts by mass] | | | | | | 0.0 | 0.0 | 0.0 | 0.0 | 0.0 | 0.0 |

TABLE 2-continued

| | | Examples | | | | | |
|---|---|---|---|---|---|---|---|
| | | 8 | 9 | 10 | 11 | 12 | 13 |
| Antistatic agent per 100 parts by mass of oil agent [parts by mass] | | 6.7 | 5.3 | 6.3 | 6.3 | 7.1 | 5.9 |
| Adhesion amount of oil agent composition [mass %] | | 1.0 | 1.1 | 0.9 | 1.0 | 0.9 | 1.1 |
| Evaluation | Ease of handling during emulsification process | A | A | A | B | A | A |
| | Bundling properties | A | A | A | A | A | A |
| | Operational efficiency | A | A | A | A | A | A |
| | Number of fused single fibers [per bundle] | 5 | 7 | 1 | 0 | 0 | 1 |
| | Strand tensile strength [GPa] | 5.2 | 5.2 | 5.1 | 5.3 | 5.4 | 5.1 |
| | Amount of scattered Si [mg/kg] | 400 | 520 | 460 | 520 | 720 | 850 |
| | Amount of scattered ester or the like [mg/kg] | 1530 | 1730 | 1460 | 840 | 390 | 570 |

TABLE 3

| | | | | | | Examples | | | | | | | | | Reference |
|---|---|---|---|---|---|---|---|---|---|---|---|---|---|---|---|
| | | | | | | 14 | 15 | 16 | 17 | 18 | 19 | 20 | 21 | 22 | 23 |
| Components [parts by mass] | Oil agent composition | Oil agent | A | Ester compound | A-1 | 20 | 40 | 20 | 25 | 10 | 35 | 13 | 10 | 9 | 5 |
| | | | X | | B-1 | | | | | | | | | | |
| | | | | | C-1 | | | 25 | 25 | 40 | | 13 | 10 | 9 | |
| | | | | | C-2 | 20 | 10 | | 15 | | 40 | | | | 5 |
| | | | | | G-2 | | | | | | | | | | |
| | | | Other | | E-1 | | | | | | | | | | |
| | | | H | Amino-modified silicone | H-1 | 20 | 20 | 15 | 15 | 10 | 5 | 42 | 52 | 52 | 30 |
| | | | | | H-9 | | | | | | | | | | |
| | | | | | H-4 | | | | | | | | | | |
| | H/(A + H + X + other) | | | | | 0.33 | 0.29 | 0.25 | 0.19 | 0.17 | 0.06 | 0.62 | 0.72 | 0.74 | 0.75 |
| | A/(A + X + other) | | | | | 0.50 | 0.80 | 0.44 | 0.38 | 0.20 | 0.47 | 0.50 | 0.50 | 0.50 | 0.50 |
| | | Nonionic surfactant | | | K-1 | | | | | | | | | | |
| | | | | | K-2 | | | | | | | | | | |
| | | | | | K-3 | | | | | | | | | | |
| | | | | | K-4 | 20 | 15 | 25 | 35 | 40 | 10 | 32 | 28 | 30 | 30 |
| | | | | | K-5 | | | | | | | | | | |
| | | | | | K-6 | | | | | | | | | | |
| | | | | | K-7 | | | | | | | | | | |
| | | | | | K-10 | 20 | 15 | 10 | | | 10 | | | | 30 |
| | | Antioxidant | | | L-1 | | | | | | | | | | |
| | | | | | L-2 | | | | | | | | | | |
| | | Antistatic agent | | | M-2 | | | | | | | | | | |
| | A + H + X + other [parts by mass] | | | | | 60 | 70 | 60 | 80 | 60 | 80 | 68 | 72 | 70 | 40 |
| | Nonionic surfactant per 100 parts by mass of oil agent [parts by mass] | | | | | 66.7 | 42.9 | 58.3 | 43.8 | 66.7 | 25.0 | 47.1 | 38.9 | 42.9 | 150 |
| | Antioxidant per 100 parts by mass of oil agent [parts by mass] | | | | | 0.0 | 0.0 | 0.0 | 0.0 | 0.0 | 0.0 | 0.0 | 0.0 | 0.0 | 0.0 |
| | Antistatic agent per 100 parts by mass of oil agent [parts by mass] | | | | | 0.0 | 0.0 | 0.0 | 0.0 | 0.0 | 0.0 | 0.0 | 0.0 | 0.0 | 0.0 |
| | Adhesion amount of oil agent composition [mass %] | | | | | 0.9 | 1.0 | 1.1 | 1.1 | 1.0 | 1.0 | 1.0 | 1.0 | 1.0 | 0.8 |
| Evaluation | Ease of handling during emulsification process | | | | | A | A | A | A | A | A | A | A | A | A |
| | Bundling properties | | | | | A | A | A | A | A | A | A | A | A | C |
| | Operational efficiency | | | | | A | A | A | A | A | A | A | A | A | C |
| | Number of fused single fibers [per bundle] | | | | | 3 | 0 | 4 | 3 | 5 | 4 | 2 | 0 | 1 | 1 |
| | Strand tensile strength [GPa] | | | | | 5.2 | 5.4 | 5.3 | 5.3 | 5.1 | 5.0 | 5.2 | 5.2 | 5.2 | 4.1 |
| | Amount of scattered Si [mg/kg] | | | | | 110 | 120 | 100 | 110 | 90 | 80 | 400 | 540 | 540 | 240 |
| | Amount of scattered ester or the like [mg/kg] | | | | | 1590 | 1790 | 1820 | 2450 | 1920 | 2790 | 780 | 700 | 630 | 330 |

TABLE 4

| | | | | | | Comparative Examples | | | | | | | | |
|---|---|---|---|---|---|---|---|---|---|---|---|---|---|---|
| | | | | | | 1 | 2 | 3 | 4 | 5 | 6 | 7 | 8 | 9 |
| Components [parts by mass] | Oil agent composition | Oil agent | A | Ester compound | A-1 | 45 | | | | | | 10 | 20 | 30 |
| | | | X | | B-1 | | | | | | | 50 | 40 | |
| | | | | | C-1 | | 10 | | | | | | | 30 |
| | | | | | C-2 | | | 25 | | | | | | |
| | | | | | G-2 | | | | | 43 | | | | |
| | | | Other | | E-1 | | | | 40 | | | | | |
| | | | H | Amino-modified silicone | H-1 | 50 | | 50 | 40 | 57 | 90 | | | |
| | | | | | H-9 | | | | | | | | | |
| | | | | | H-4 | | | | | | | | | |

TABLE 4-continued

| | | | Comparative Examples | | | | | | | | |
|---|---|---|---|---|---|---|---|---|---|---|---|
| | | | 1 | 2 | 3 | 4 | 5 | 6 | 7 | 8 | 9 |
| | H/(A + H + X + other) | | 0.67 | 0.00 | 0.67 | 0.50 | 0.57 | 1.00 | 0.00 | 0.00 | 0.00 |
| | A/(A + X + other) | | 1.00 | 0.82 | 0.00 | 0.00 | 0.00 | — | 0.17 | 0.33 | 0.50 |
| | Nonionic surfactant | K-1 | | | | | 27 | | 20 | 20 | |
| | | K-2 | | 20 | | | | | | 20 | 20 |
| | | K-3 | | 25 | | | | | 20 | | 20 |
| | | K-4 | 30 | | 30 | | 13 | | | | |
| | | K-5 | | | | 5 | | 9 | | | |
| | | K-6 | | | | 9 | | | | | |
| | | K-7 | | | | 5 | | | | | |
| | | K-10 | | | | | | | | | |
| | Antioxidant | L-1 | | | | | 3 | | | | |
| | | L-2 | | | | 1 | | 1 | | | |
| | Antistatic agent | M-2 | 5 | | 5 | | | | | | |
| A + H + X + other [parts by mass] | | | 75 | 55 | 75 | 80 | 100 | 90 | 60 | 60 | 60 |
| Nonionic surfactant per 100 parts by mass of oil agent [parts by mass] | | | 40.0 | 81.8 | 40.0 | 23.8 | 40.0 | 10.0 | 66.7 | 66.7 | 66.7 |
| Antioxidant per 100 parts by mass of oil agent [parts by mass] | | | 0.0 | 0.0 | 0.0 | 1.3 | 3.0 | 1.1 | 0.0 | 0.0 | 0.0 |
| Antistatic agent per 100 parts by mass of oil agent [parts by mass] | | | 6.7 | 0.0 | 6.7 | 0.0 | 0.0 | 0.0 | 0.0 | 0.0 | 0.0 |
| Adhesion amount of oil agent composition [mass %] | | | 1.1 | 1.1 | 0.9 | 1.2 | 1.1 | 1.2 | 1.0 | 0.9 | 0.8 |
| Evaluation | Ease of handling during emulsification process | | C | C | A | A | A | A | A | A | B |
| | Bundling properties | | A | A | A | A | A | A | A | A | A |
| | Operational efficiency | | A | A | A | A | A | A | A | A | A |
| | Number of fused single fibers [per bundle] | | 0 | 1 | 13 | 12 | 20 | 1 | 17 | 10 | 4 |
| | Strand tensile strength [GPa] | | 5.5 | 5.1 | 5.1 | 5.5 | 5.0 | 5.1 | 5.1 | 5.2 | 5.3 |
| | Amount of scattered Si [mg/kg] | | 550 | 0 | 580 | 440 | 660 | 1050 | 0 | 0 | 0 |
| | Amount of scattered ester or the like [mg/kg] | | 690 | 1480 | 920 | 4970 | 360 | 0 | 3060 | 2860 | 2170 |

TABLE 5

| | | | | | | Comparative Examples | | | | | | |
|---|---|---|---|---|---|---|---|---|---|---|---|---|
| | | | | | | 10 | 11 | 12 | 13 | 14 | 15 | 16 |
| Components [parts by mass] | Oil agent composition | Oil agent | A | Ester compound | A-1 | 80 | 30 | | | 40 | 65 | 5 |
| | | | X | | B-1 | | | | | | | |
| | | | | | C-1 | 80 | | 30 | | 20 | | 65 |
| | | | | | C-2 | | | | | | 5 | |
| | | | | | G-2 | | | | | | | |
| | | | Other | | E-1 | | | | | | | |
| | | | H | Amino-modified silicone | H-1 | | | | 80 | | | |
| | | | | | H-9 | | | | | | | |
| | | | | | H-4 | | | | | 15 | | |
| | H/(A + H + X + other) | | | | | 0.00 | 0.00 | 0.00 | 1.00 | 0.20 | 0.00 | 0.00 |
| | A/(A + X + other) | | | | | 0.00 | 1.00 | 1.00 | 0.00 | 0.67 | 0.93 | 0.07 |
| | Nonionic surfactant | | | | K-1 | | | | | | | |
| | | | | | K-2 | | | | | | | |
| | | | | | K-3 | | | | | | | |
| | | | | | K-4 | 20 | 10 | 20 | 20 | 15 | 15 | 15 |
| | | | | | K-5 | | | | | | | |
| | | | | | K-6 | | | | | | | |
| | | | | | K-7 | | | | | | | |
| | | | | | K-10 | | 10 | 20 | | 10 | 15 | 15 |
| | Antioxidant | | | | L-1 | | | | | | | |
| | | | | | L-2 | | | | | | | |
| | Antistatic agent | | | | M-2 | | | | | | | |
| A + H + X + other [parts by mass] | | | | | | 80 | 80 | 60 | 80 | 75 | 70 | 70 |
| Nonionic surfactant per 100 parts by mass of oil agent [parts by mass] | | | | | | 25.0 | 25.0 | 66.7 | 25.0 | 33.3 | 42.9 | 42.9 |
| Antioxidant per 100 parts by mass of oil agent [parts by mass] | | | | | | 0.00 | 0.00 | 0.00 | 0.00 | 0.00 | 0.00 | 0.00 |
| Antistatic agent per 100 parts by mass of oil agent [parts by mass] | | | | | | 0.00 | 0.00 | 0.00 | 0.00 | 0.00 | 0.00 | 0.00 |
| Adhesion amount of oil agent composition [mass %] | | | | | | 0.8 | 0.9 | 1.0 | 1.1 | 1.1 | 1.2 | 1.0 |
| Evaluation | Ease of handling during emulsification process | | | | | A | C | B | A | B | C | A |
| | Bundling properties | | | | | A | A | B | A | A | A | A |
| | Operational efficiency | | | | | B | B | A | A | C | A | B |
| | Number of fused single fibers [per bundle] | | | | | 25 | 1 | 8 | 4 | 28 | 0 | 19 |
| | Strand tensile strength [GPa] | | | | | 4.7 | 4.8 | 4.9 | 5.1 | 4.7 | 4.8 | 4.6 |
| | Amount of scattered Si [mg/kg] | | | | | 0 | 0 | 0 | 1220 | 110 | 0 | 0 |
| | Amount of scattered ester or the like [mg/kg] | | | | | 3540 | 2950 | 2170 | 0 | 280 | 2770 | 3080 |

As clearly shown in Tables 1, 2 and 3, the amount of adhered oil agent composition was appropriate in each example. The bundling properties of carbon-fiber-precursor acrylic fiber bundles and operational efficiency in the production process were excellent. In all the Examples, no operational issues were identified that would affect the continuous production of carbon-fiber bundles.

Carbon-fiber bundles obtained in each Example had high quality with only a small number of fusions found among single fibers. Also, the carbon-fiber bundles showed high tensile strength, and mechanical properties were excellent. In addition, since the silicone content in the oil agent was reduced and high heat-resistant non-silicone components (ester components) were selected, the amounts of scattered silicone and non-silicone components were less during the calcination process, and the processing load was low during calcination.

Regarding Example 11, prepared by using hydroxybenzoate (A-1) and amino-modified silicone (H-9), while using cyclohexanedicarboxylate (C-2) as the organic compound (X) at a small amount relative to the amount of hydroxybenzoate (A-1), the emulsification process was slightly harder during the preparation of an emulsion of the oil agent composition than the process in other Examples.

Regarding Examples 12 and 13, each prepared by using amino-modified silicone (H-1 or H-9), hydroxybenzoate (A-1) and cyclohexanedicarboxylate (B-1) as the organic compound (X) at a small amount relative to the amount of the amino-modified silicone (H), the amount of scattered silicone components during calcination was greater than those in other Examples.

In each of Examples 14 to 19, substantially no fusion was found among single fibers, the fiber tensile strength was high, and mechanical properties were excellent even when using a large tow with a relatively greater number of fibers (single fiber fineness of 1.0 dtex, 60000 single fibers in a fiber bundle). In addition, low silicone content contributed to substantially no Si scattering during the calcination process. Accordingly, processing load during calcination was low. By contrast, in each of Examples 20 to 22, although the amount of scattered Si during calcination was greater than those observed in Examples 14 to 19, the scattered amount was within the allowable range. In addition, substantially no fusion was found among single fibers, fiber tensile strength was high, mechanical properties were excellent, and the process load during calcination was low.

The strand tensile strength of the carbon-fiber bundle obtained in each Example was at the same level or greater even when compared with the levels observed in Comparative Examples 6 and 13, which were prepared by using amino-modified silicone (H) as the main component.

In Reference Example 23, since the content of a nonionic surfactant was greater, that is, 150 parts by mass relative to 100 parts by mass of the oil agent, bundling properties were insufficient and operational efficiency was low.

As is evident from Tables 4 and 5, Comparative Example 1, prepared by using hydroxybenzoate (A-1) and amino-modified silicone (H-1) but without using an organic compound (X), showed difficulty during an emulsification process to prepare an emulsion of the oil agent composition.

Comparative Example 2, prepared by using hydroxybenzoate (A-1) but without amino-modified silicone (H-1), while using cyclohexanedicarboxylate (C-1) as the organic compound (X) at only a small amount relative to the amount of (A-1), showed difficulty during an emulsification process to prepare an emulsion of the oil agent composition.

Comparative Examples 3, 4 and 5 were respectively prepared by using amino-modified silicone (H-1), and as the organic compound (X), cyclohexanedicarboxylate (C-2), cyclohexanedimethanol ester (E-1) or a polyoxyethylene bisphenol A laurate (G-2), but without using hydroxybenzoate (A). When the number of fusions among single fibers in each carbon-fiber bundle was counted, there were many fusions found and the numbers were not within an allowable range in terms of the quality of carbon-fiber bundles. Also, Comparative Example 4 showed a greater amount of vapor scattering during the calcination process of (E-1). In terms of contamination during calcination, and decreased productivity caused by cohered substances of non-silicone components reattached to the precursor-fiber bundle, the scattered amount was beyond the allowable level.

In Comparative Example 6, prepared by using amino-modified silicone (H-1) but without hydroxybenzoate (A) or organic compound (X), a greater amount of scattered silicone component was observed during calcination than those in Examples 12 and 13. The scattered amount was beyond the allowable level from a productivity point of view.

Comparative Examples 7 and 8, each prepared by using hydroxybenzoate (A-1), and cyclohexanedicarboxylate (B-1) as the organic compound (X) but without amino-modified silicone (H), each showed a greater amount of scattered non-silicone component (ester component) during the calcination process. In terms of contamination during calcination, and decreased productivity caused by cohered substances of non-silicone components reattached to the precursor-fiber bundle, the scattered amount was beyond the allowable level. Moreover, there were many fused single fibers found in the carbon-fiber bundles, and the numbers were beyond the allowable range when the quality of carbon-fiber bundles was considered.

In Comparative Example 9, prepared by using hydroxybenzoate (A-1) and cyclohexanedicarboxylate (C-1) as the organic compound (X) at a content ratio of 1:1, while not using amino-modified silicone (H), the emulsification process was slightly difficult during the preparation of an emulsion of the oil agent composition.

Moreover, when cyclohexanedicarboxylate (C-1) was used but neither hydroxybenzoate (A) nor amino-modified silicone (H) was used (Comparative Example 10); when hydroxybenzoate (A-1) was used but neither organic compound (X) nor amino-modified silicone (H) was used (Comparative Example 11); when hydroxybenzoate (A-1) and cyclohexanedicarboxylate (C-1) were used but amino-modified silicone (H) was not used (Comparative Example 12); when cyclohexanedicarboxylate (C-1) and hydroxybenzoate (A-1) were mixed at a ratio of 1:13 (Comparative Example 15); and when cyclohexanedicarboxylate (C-1) and hydroxybenzoate (A-1) were mixed at a ratio of 13:1 (Comparative Example 16), the results were excellent in each of Comparative Examples, showing an appropriate adhesion amount of the oil agent composition and substantially no Si scattering was observed during the calcination process. However, the fiber tensile strength was lower than that in each Example.

When amino-modified silicone (H) was used but neither hydroxybenzoate (A) nor organic compound (X) was used (Comparative Example 13), bundling properties and operational efficiency were excellent, and no fusion was observed in the produced carbon-fiber bundle. Also, the fiber tensile strength was almost the same as that in each Example. However, since silicone was used, a greater amount of scattered Si was observed during the stabilization process. Accordingly, a greater load is to be exerted on the calcination process, thus posing an issue that could affect the continuous industrial production of carbon-fiber bundles.

When amino-modified silicone (H-4) with a kinematic viscosity of 10000 $mm^2/s$ and having primary and secondary amines on its side chain was used (Comparative Example 14), the operational stability was notably low, while there were many fusions observed among single fibers.

INDUSTRIAL APPLICABILITY

According to the present invention, an oil agent for carbon-fiber-precursor acrylic fibers, an oil agent composition containing the oil agent, and an oil-treatment-liquid with the oil agent composition dispersed in water effectively suppress fusion among single fibers during the calcination process, while suppressing a reduction in operational efficiency caused by using silicone-based oil agents. As a result, carbon-fiber-precursor acrylic fiber bundles with excellent bundling properties are obtained, and carbon-fiber bundles with excellent mechanical properties are produced at high yield from such carbon-fiber-precursor acrylic fiber bundles.

In addition, the carbon-fiber-precursor acrylic fiber bundles according to the present invention effectively suppress fusion among single fibers during the calcination process, while suppressing a reduction in operational efficiency caused by using silicone-based oil agents. Furthermore, carbon-fiber bundles with excellent mechanical properties are produced at high yield.

Carbon-fiber bundles obtained from carbon-fiber-precursor acrylic fiber bundles related to the present invention are made into prepreg and formed as composite materials. In addition, composite materials formed with the carbon-fiber bundles are suitable for sports applications such as golf shafts, fishing rods and the like. Moreover, such composite materials are used as structural materials in automobile and aerospace industries, or for storage tanks for various gases.

The invention claimed is:

1. An oil agent, comprising:

a hydroxybenzoate (A) of formula (1a);

an amino-modified silicone (H) of formula (3e); and an organic compound (X) which has affinity with the hydroxybenzoate (A) and a residual mass rate ($R^1$) of 70 to 100 mass % at 300° C. measured by thermogravimetry in air and which is liquid at 100° C.:

(1a)

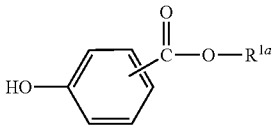

wherein in formula (1a), $R^{1a}$ is a C8 to C20 hydrocarbon group, (3e)

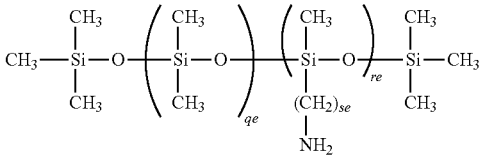

wherein in formula (3e), "qe" and "re" are any number of 1 or greater, "se" is any number of 1 to 5, and the dimethylsiloxane units and methylaminoalkyl-siloxane units are in a random sequence.

2. The oil agent according to claim 1, wherein the organic compound (X) is at least one type selected from a group of types consisting of a cyclohexanedicarboxylate (B) of formula (1b), a cyclohexanedicarboxylate (C) of formula (2b), and a fatty acid ester of polyoxyethylene bisphenol A (G) of formula (2e); and the oil agent satisfies conditions (a) and (b):

Condition (a): a mass ratio of the total content of hydroxybenzoate (A), amino-modified silicone (H) and organic compound (X) to a content of amino-modified silicone (H) [(H)/[(A)+(H)+(X)]] is 0.05 to 0.8; and Condition (b): a mass ratio of the total content of hydroxybenzoate (A) and organic compound (X) to a content of hydroxybenzoate (A) [(A)/[(A)+(X)]] is 0.1 to 0.8;

(1b)

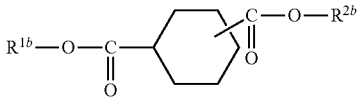

wherein in formula (1b), $R^{1b}$ and $R^{2b}$ are each independently a C8 to C22 hydrocarbon group;

(2b)

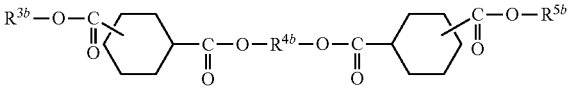

wherein in formula (2b), $R^{3b}$ and $R^{5b}$ are each independently a C8 to C22 hydrocarbon group, and $R^{4b}$ is a C2 to C10 hydrocarbon group or residue obtained by removing two hydroxyl groups from a polyoxyalkylene glycol consisting of a C2 to C4 oxyalkylene group;

(2e)

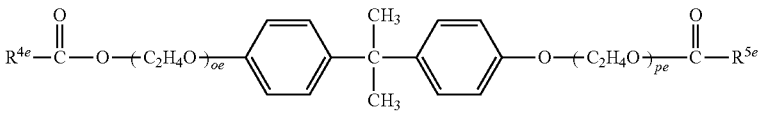

wherein in formula (2e), $R^{4e}$ and $R^{5e}$ are each independently a C7 to C21 hydrocarbon group, and "oe" and "pe" are independently any number of 1 to 5.

3. The oil agent according to claim 2, wherein the mass ratio [(H)/[(A)+(H)+(X)]] is 0.2 to 0.8.

4. The oil agent according to claim 2, wherein the mass ratio [(H)/[(A)+(H)+(X)]] is 0.4 to 0.8.

5. The oil agent according to claim 2, wherein the mass ratio [(H)/[(A)+(H)+(X)]] is 0.5 to 0.8.

6. An oil agent composition, comprising:

an oil agent according to claim 1; and a nonionic surfactant.

7. The oil agent composition according to claim 6, wherein the nonionic surfactant is contained at 10 to 100 parts by mass relative to 100 parts by mass of the oil agent.

8. An oil-treatment-liquid, comprising:

an oil agent composition according to claim 6, wherein the oil agent composition is dispersed in water.

9. A carbon-fiber-precursor acrylic fiber bundle, comprising:

carbon fiber precursor acrylic fibers, wherein an oil agent is applied thereon, and the oil agent comprises a hydroxybenzoate (A) of formula (1a);

an amino-modified silicone (H) of formula (3e) below; and an organic compound (X), which has affinity with the hydroxybenzoate (A), and a residual mass rate (R1) of 70 to 100 mass % at 300° C. measured by thermogravimetry in air, and which is liquid at 100° C.:

(1a)

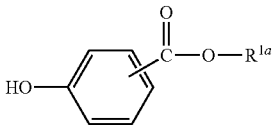

wherein in formula (1a), $R^{1a}$ is a C8 to C20 hydrocarbon group;

(3e)

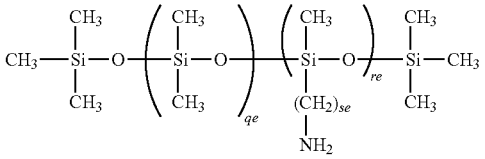

wherein in formula (3e), "qe" and "re" are respectively any number of 1 or greater, "se" is any number of 1 to 5, and the dimethylsiloxane units and methylamino-alkyl-siloxane units are in a random sequence.

10. The carbon-fiber-precursor acrylic fiber bundle according to claim 9, wherein the organic compound (X) is at least one type selected from a group of types consisting of a cyclohexanedicarboxylate (B) of formula (1b), a cyclohexanedicarboxylate (C) of formula (2b), and a fatty acid ester of polyoxyethylene bisphenol A (G) of formula (2e); and the oil agent satisfies conditions (a) and (b):

Condition (a): a mass ratio of the total content of hydroxybenzoate (A), amino-modified silicone (H) and organic compound (X) to a content of amino-modified silicone (H) [(H)/[(A)+(H)+(X)]] is 0.05 to 0.8; and Condition (b): a mass ratio of the total content of hydroxybenzoate (A) and organic compound (X) to a content of hydroxybenzoate (A) [(A)/[(A)+(X)]] is 0.1 to 0.8;

(1b)

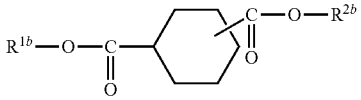

wherein in formula (1b), $R^{1b}$ and $R^{2b}$ are each independently a C8 to C22 hydrocarbon group;

(2b)

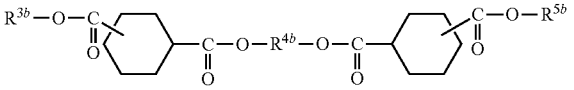

wherein in formula (2b), $R^{3b}$ and $R^{5b}$ are each independently a C8 to C22 hydrocarbon group, and $R^{4b}$ is a C2 to C10 hydrocarbon group or residue obtained by removing two hydroxy groups from a polyoxyalkylene glycol consisting of a C2 to C4 oxyalkylene group;

(2e)

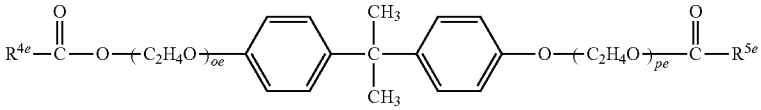

wherein in formula (2e), $R^{4e}$ and $R^{5e}$ are each independently a C7 to C21 hydrocarbon group, and "oe" and "pe" are independently 1 to 5.

11. The carbon-fiber-precursor acrylic fiber bundle according to claim 10, wherein the mass ratio [(H)/[(A)+(H)+(X)]] is 0.2 to 0.8.

12. The carbon-fiber-precursor acrylic fiber bundle according to claim 10, wherein the mass ratio [(H)/[(A)+(H)+(X)]] is 0.4 to 0.8.

13. The carbon-fiber-precursor acrylic fiber bundle according to claim 10, wherein the mass ratio [(H)/[(A)+(H)+(X)]] is 0.5 to 0.8.

14. The carbon-fiber-precursor acrylic fiber bundle according to claim 9, wherein a nonionic surfactant is further adhered to the carbon-fiber-precursor acrylic fiber bundle.

15. A method for producing a carbon-fiber bundle, comprising:

heating a carbon-fiber-precursor acrylic bundle according to claim 9 at a temperature of from 200 to 300° C. in an oxidizing atmosphere under tension to convert the carbon-fiber-precursor acrylic bundle to a stabilized fiber bundle; and carbonizing the stabilized fiber bundle at an upper temperature of 1000° C. or higher in an inert atmosphere.

* * * * *